US005158694A

United States Patent [19]

Waynick

[11] Patent Number: 5,158,694

[45] **Date of Patent: * Oct. 27, 1992**

[54] RAILROAD GREASE

[75] Inventor: John A. Waynick, Bolingbrook, Ill.

[73] Assignee: Amoco Corporation, Chicago, Ill.

[ * ] Notice: The portion of the term of this patent subsequent to May 29, 2007 has been disclaimed.

[21] Appl. No.: 738,264

[22] Filed: Jul. 31, 1991

Related U.S. Application Data

[63] Continuation-in-part of Ser. No. 590,482, Sep. 9, 1990, Pat. No. 5,096,605, which is a continuation-in-part of Ser. No. 332,509, Mar. 31, 1989, Pat. No. 5,000,862.

[51] Int. Cl.[5] ..... C10M 125/10

[52] U.S. Cl. ..... 252/18; 252/25; 252/32.5; 252/32.7 E; 252/33.6; 252/50; 252/51.5 A; 252/56 R

[58] Field of Search ..... 252/18, 25, 32.5, 32.7 E, 252/51.5 A, 56 R

[56] References Cited

U.S. PATENT DOCUMENTS

| | | | |
|---|---|---|---|
| 3,846,315 | 11/1974 | Staton et al. | 252/25 |
| 4,902,435 | 2/1990 | Waynick | 252/25 |
| 4,929,371 | 5/1990 | Waynick | 252/25 |
| 5,000,862 | 3/1991 | Waynick | 252/25 |

*Primary Examiner*—Jacqueline Howard

*Attorney, Agent, or Firm*—Thomas W. Tolpin; William H. Magidson; Frank J. Sroka

[57] ABSTRACT

A high performance, environmentally compatible railroad grease effectively lubricates railroad tracks and wheels of railway cars in compliance with environmental rules and regulations. Advantageously, the novel railroad grease is safe for plant life and animals as well as for fish in underground aquifers and nearby streams. The railroad grease desirably comprises a special adhesive polymer and an extreme pressure, anti-wear additive package, preferably a food grade additive package, comprising carbonates combined with sulfates or phosphates.

25 Claims, No Drawings

RAILROAD GREASE

CROSS REFERENCE TO RELATED APPLICATIONS

This patent application is a continuation-in-part of the patent application of John Andrew Waynick, Ser. No. 07/590,482, filed Sep. 9, 1990, entitled "Aluminum Soap Thickened Steel Mill Grease," now U.S. Pat. No. 5,096,605 which is a continuation-in-part of the patent application of John Andrew Waynick, U.S. Pat. No. 5,000,862, issued Mar. 19, 1991, Ser. No. 07/332,509, filed Mar. 31, 1989, entitled "Process for Protecting Bearings in Steel Mills and Other Metal Processing Mills."

BACKGROUND OF THE INVENTION

This invention pertains to lubricants and, more particularly, to an adhesive, friction-reducing grease particularly effective for lubrication of the interface between the side of a railroad track and the wheel flanges of trains.

Lubrication of the sides of railroad tracks has been practiced by the railroad industry for the last 50 years. Until recently, such practice was limited to areas of the track where curves existed. It is in such curved track that the wheel flanges can come into more direct contact with the track sides. The application of a lubricant to the track sides before the curve and the action of the train wheels to spread the lubricant along the track through the curved portion provides friction reduction and reduced track and wheel wear.

However, numerous studies done within the last ten years have shown that significant additional benefits can be achieved if the tangent (straight) as well as curved track is lubricated. The reasons for this are not completely understood but are believed, at least in part, to be due to a less than perfect parallel alignment of wheels and track which exists on most if not all trains.

One benefit of increased lubrication of railroad track sides is further reduction in frictional drag at the track side/wheel flange interface. Reports from various railroads indicate that this additional friction reduction can result in between 10% and 30% fuel savings. Other benefits of increased lubrication of railroad track sides include reduced track and wheel wear, and reduced noise levels in urban settings.

There are three common methods to apply the lubricant to the railroad track side. The oldest method is the wayside lubricator. This device comprises a sealed reservoir of lubricant near the track. Connected to this reservoir is a length of piping to convey the lubricant to some manner of nozzle or other applicator on the track side. When a train begins to pass over that portion of track, a sensor is activated and lubricant from the reservoir is pumped out the nozzle. Each set of wheels commonly gets a shot of lubricant which is then spread down the track. The wayside lubricator was the main method of application when only curved track was being lubricated. The disadvantages of wayside lubricators are that they are usually in remote areas and therefore require special trips by service personnel when malfunctions occur. Because they are constantly exposed to the elements, malfunctions occur frequently.

The second method of application of lubricant to the railroad track side is by a special mobile applicator. This mobile applicator can be a two-wheeled trailer type apparatus connected to the back of a rail inspector's truck. Sometimes the apparatus is mounted in the payload area of the rail inspector's truck. In either case, as the rail inspector drives his truck down the railroad track inspecting the rails for excessive wear or fatigue failures, the apparatus applies the lubricant to the track sides and also assists in spreading it down the track. While this method does not suffer from the disadvantages of the wayside lubricator, it does require special equipment which is utilized on trips not made by railroad trains.

The third method of application of lubricant to the railroad track is by using equipment that is on board the train locomotive itself. The components of the on-board lubricator are in the most general sense similar to that of the wayside lubricator: a lubricant reservoir, application nozzles, and piping to convey the lubricant from the reservoir to the nozzles. Each nozzle is positioned in near proximity to one of the locomotive's wheel flanges and is designed to provide a spray pattern of lubricant to the wheel flange as the train is moving. The wheel flange spreads the lubricant to the track side and down the track as the train moves. Most frequently, when the on-board lubrication system is operating, a metered amount of lubricant is fed to the nozzle per length of track. Some more advanced on-board lubrication systems also have a curve-sensing device. This device detects when the train is traveling over a curved portion of track and automatically increases the amount of lubricant being metered out to provide additional friction reduction and wear protection. Although on-board lubricators are a capital investment for each locomotive, they have many advantages not realized by other methods and are rapidly growing as a method of choice for application of lubricant on railroad track sides.

Given a particular method of application to the sides of the railroad track, the level of benefits achieved will depend on the properties of the lubricant used. Several properties are desirable for a high performance railroad track/wheel flange lubricant. The lubricant should have sufficient pumpability and mobility so that it is easily applied by the nozzle. Once applied the lubricant should transfer from the wheel flange to the rail side without fling-off. The lubricant should have excellent adherence properties which allow it to remain on the rail side, be spread far down the track, and not migrate to the top of the rail. Once on the rail, the grease should resist being washed off by water (rain) so that several trains can pass over it before relubrication is required. This combination of adhesion, spreadability, and water resistance as they apply to a railroad track/wheel flange grease is sometimes referred to as retentivity. The railroad track/wheel flange lubricant should have minimal oil separation (bleed) characteristics. It is believed that the contact pressure between the rail side and the wheel flange can become as high as one-half million pounds per square inch. Accordingly, the railroad track/wheel flange lubricant should have excellent extreme pressure (EP) and antiwear (AW) properties. The lubricant should most desirably provide this EP/AW characteristic without being corrosive to ferrous metals. Instantaneous contact temperatures at the railroad track/wheel flange interface have been estimated in excess of 350° F. Any lubricant which is corrosive to the rail surface at such temperatures may, over many train passes and long periods of time, promote corrosive fatigue of the rail. This is particularly serious since rail fatigue is a major cause of train derailments. Finally, since this lubricant is being applied on railroad tracks which network the entire country, the lubricant should be environmentally acceptable.

Over the years, a variety of lubricants have been used and suggested for use to lubricate the railroad track/-wheel flange interface. Most of these lubricants have been greases, due in part to their superiority of application without fling-off. These greases are typified by the well known group of greases which comprises a thickener of simple fatty acid soap salts of calcium or lithium and further comprise graphite and/or molybdenum disulfide as extreme pressure and antiwear additives. Also suggested are stable mineral oil (base oil) dispersions of graphite and/or molybdenum disulfide such as those found in U.S. Pat. No. 4,634,545.

These products, while having provided a certain degree of success, do have shortcomings with respect to the above-mentioned properties. In particular, greases or mineral oil dispersions which contain graphite are often limited in their level of EP/AW performance. This is because the graphite most commonly used in such products is a material commonly known as amorphous graphite. The term amorphous graphite is technically a misnomer since such material is virtually devoid of the extended laminar, hexagonal carbon arrays necessary for true graphitic structure. Amorphous graphite is usually about 75% carbon and about 25% abrasive oxides of silicon, aluminum, and iron. Instead of providing high levels of EP/AW performance, amorphous graphite is extremely abrasive. The main reason for its widespread use in lubricants appears to be its very low cost. More expensive synthetic graphites or highly pure natural graphites (with true graphitic structure) are superior to amorphous graphite as lubricity additives. However, even these materials have significant levels of abrasive oxides of silicon, aluminum, and iron. Furthermore, although these graphites are fairly effective as AW additives under low loads, they are limited in their ability to perform under high loads. Another disadvantage of graphites is their corrosivity at high temperature. The reason for this is most likely due to the presence of adsorbed, corrosive impurities. In any event, even purified graphite will exhibit this distinct corrosive nature, as easily demonstrated by high temperature copper corrosion testing of the corresponding lubricant.

Railroad track/wheel flange lubricants containing molybdenum disulfide suffer from similar deficiencies. Molybdenum disulfide, in its purified form is relatively free from abrasive contaminants and is generally superior to graphite as a wear prevention additive at low loading levels. However, at high loads, the performance of molybdenum disulfide rapidly decreases. The sulfur content of molybdenum disulfide makes it quite corrosive in lubricants at temperatures such as 350° F. Also, the fundamental presence of the heavy metal molybdenum makes such lubricants increasingly unattractive from an environmental viewpoint because it can be harmful to plant life and animals. Finally, molybdenum disulfide is very expensive, making its use in lubricants costly.

It is, therefore, desirable to provide an improved railroad track/wheel flange grease which overcomes many, if not all, of the preceding problems.

SUMMARY OF THE INVENTION

An improved adherent, friction-reducing grease is provided which is particularly useful as a high performance railroad track/wheel flange lubricant. The lubricant provides good friction reduction and provides excellent adherence, the exact amount of which can be controlled by variations in the levels of the components of its novel composition. The water resistance is also excellent, in direct accordance with its adherence properties. The novel adherent, friction-reducing grease has outstanding extreme pressure and wear resistance properties which are, advantageously, provided without imparting any corrosivity, even when the lubricant is exposed to ferrous or non-ferrous metals at high temperatures, e.g., at 350° F. for extended periods of time. Advantageously, the novel railroad (railway) track grease has superior retentivity and mobility qualities and spreads easily down the railroad track with no substantial fling-off or migration to the top of the railroad track. Desirably, the novel grease is non-abrasive, has excellent (low) oil separation properties, good pumpability, and is environmentally safe. This latter characteristic is achieved because the extreme pressure and wear resistance components of the novel grease are food grade materials. Since none of the materials in the novel grease have any substantial color, the final grease will be neutral in color unless dyed to a specific color. In any event, the novel grease of this invention will not have the unsightly pitch black color of lubricants which contain graphite or molybdenum disulfide.

In a recent test by an American railroad, using an actual railroad train equipped with a special instrumentation car, the novel grease provided excellent friction-reducing properties when compared with three graphite-containing lubricants, three molybdenum disulfide-containing lubricants, and one lubricant containing oil-soluble extreme pressure and wear resistance additives. Further testing showed that all the graphite-containing lubricants exhibited accelerated wear to the on-board lubricator system. The novel grease of this invention did not show any such tendency and substantially avoids molybdenum disulfide-containing compounds and abrasive oxides of silicon, aluminum and iron, as well as substantial amounts of amorphous graphite, synthetic graphites and (highly pure) natural graphites.

In addition to being used as an effective railroad track/wheel flange lubricant, the novel grease of this invention can also be used as a lubricant for the traction motor drive of train locomotives.

The novel lubricating grease has: (a) a substantial proportion of a base oil, (b) a thickener, such as polyurea, triurea, biurea, calcium soap thickener (simple or complex), aluminum soap thickener (simple or complex), or combinations thereof, (c) a sufficient amount of an additive package to impart extreme pressure antiwear properties to the grease, and (d) a sufficient amount of an adhesive polymer. The polymeric additive cooperates and is compatible (non-interfering) with the extreme pressure antiwear additive package to provide the proper balance of railroad track retentivity, friction reduction, wear reduction, mobility, and pumpability while also maintaining an environmentally safe product.

In another form the novel lubricating grease has: (a) a substantial proportion of a base oil, (b) a sufficient amount of an additive package to impart extreme pressure antiwear properties to the grease, (c) a sufficient amount of an adhesive polymer, and (d) a dropping point elevating additive comprising a minor amount of polyurea, triurea, biurea, calcium complex soap, bentonite or other clay type material, fumed silica or other appropriately modified silica materials, or combinations thereof. In this form, the thickener of the grease is provided by a surprising and unexpected interaction between the extreme pressure antiwear additive package and the adhesive polymer. The polyurea, triurea, biurea, calcium complex soap, bentonite or clay type material, silica type material, or combinations thereof are not present in an amount sufficient to provide significant thickening to the grease structure, but do increase the dropping point of the resulting grease.

In yet another form the novel lubricating grease has: (a) a substantial proportion of a base oil, (b) a sufficient amount of an additive package to impart extreme pressure antiwear properties to the grease, and (c) a sufficient amount of an adhesive polymer in the absence of any polyurea, triurea, biurea, or any of the well known fatty acid soap salt thickeners. In this form the grease consistency and dropping point is provided entirely by the surprising and unexpected interaction between the extreme pressure antiwear additive and the adhesive polymer.

In all of these forms, the novel grease may be augmented by addition of graphite. Although graphite has significant performance deficiencies, as discussed above, when used in conjunction with the novel compositional aspects of the present invention, the performance of the resulting graphite-containing greases are greatly improved over that of greases containing graphite as the sole source of EP/AW performance.

In all of these forms, the novel grease may be further augmented in its composition by a boron-containing material to further inhibit oil separation. If the novel grease is to be used in an application where high temperature corrosivity is not a problem, then oil-soluble sulfur and phosphorus-containing materials can be used to augment the composition.

The polymeric additive can comprise: polyesters, polyamides, polyurethanes, polyoxides, polyamines, polyacrylamides, polyvinyl alcohol, ethylene vinyl acetate, or polyvinyl pyrrolidone; polyolefins (polyalkylenes), such as polyethylene, polypropylene, polyisobutylene, ethylene propylene, and ethylene butylene; or polyolefin (polyalkylene) arylenes, such as polymers of ethylene styrene and styrene isoprene; polyarylene polymers such as polystyrene; polyacrylate, or polymethacrylate; or combinations, or boronated analogs (compounds) of the preceding. Preferably, the polymeric additive comprises: polyolefins (polyalkylenes), such as polyethylene, polypropylene, polyisobutylene, ethylene propylene, and ethylene butylene; or polyolefin (polyalkylene) arylenes, such as ethylene styrene and styrene isoprene; polyarylene polymers such as polystyrene.

In one form, the extreme pressure antiwear (wear-resistant) additive package comprises tricalcium phosphate in the absence of sulfur compounds, especially oil-soluble sulfur compounds. Tricalcium phosphate provides many unexpected advantages over monocalcium phosphate and dicalcium phosphate. For example, tricalcium phosphate is water-insoluble and will not be extracted from the grease if contacted with water. Tricalcium phosphate is also very nonreactive and noncorrosive to ferrous and nonferrous metals even at very high temperatures. It is also nonreactive and compatible with most if not all of the elastomers in which lubricants may contact.

On the other hand, monocalcium phosphate and dicalcium phosphate are water-soluble. When water comes into significant contact with monocalcium or dicalcium phosphate, they have a tendency to leach, run, extract, and wash out of the grease. This destroys any significant antiwear and extreme pressure qualities of the grease. Monocalcium phosphate and dicalcium phosphate are also protonated and have acidic hydrogen present which can at high temperature adversely react and corrode ferrous and nonferrous metals as well as degrade many elastomers.

In another form, the extreme pressure antiwear additive package comprises carbonates and phosphates together preferably in the absence of sulfur compounds including oil-soluble sulfur compounds and insoluble arylene sulfide polymers. The carbonates and phosphates are of a Group 2a alkaline earth metal, such as beryllium, magnesium, calcium, strontium, and barium, or a Group 1a alkali metal, such as lithium, sodium, potassium, rubidium, cesium, and fracium. Calcium carbonate and tricalcium phosphate are preferred for best results because they are economical, stable, nontoxic, water-insoluble, and safe.

The use of both carbonates and phosphates in the additive package produced unexptected surprisingly good results over the use of greater amounts of either carbonates alone or phosphates alone. For example, the use of both carbonates and phosphates produced superior wear protection in comparison to a similar grease with a greater amount of carbonates in the absence of phosphates, or a similar grease with a greater amount of phosphates in the absence of carbonates. Furthermore, the synergistic combination of calcium carbonate and tricalcium phosphate can reduce the total additive level over a single additive and still maintain superior performance over a single additive.

The non-corrosivity of the mixture of phosphates and carbonates at very high temperatures is also in marked contrast to oil-soluble sulfur-containing materials. The use of sulfur compounds, such as oil soluble sulfur-containing compounds, should generally be avoided in the additive package of railroad track/wheel flange greases because they are chemically corrosive and detrimental to the metal rail surface at the high temperatures which can momentarily occur as the train passes. Oil-soluble sulfur compounds, by virtue of their corrosive nature, may, under high temperature, high mechanical stress (loading) conditions, accelerate the onset of metal fatigue failure. If this process occurs during the long-term use of a railroad track/wheel flange grease, the result could be derailment.

In another form, the extreme pressure antiwear additive package comprises sulfates and carbonates together, in the absence of halogenated materials. The sulfates are of a Group 2a alkaline earth metal, such as beryllium, magnesium, calcium, strontium, and barium, or a Group 1a alkali metal, such as lithium, sodium, and potassium. The carbonates are of a Group 2a alkaline earth metal or of a Group 1a alkali metal such as those described above. Calcium sulfate and calcium carbonate are preferred for best results and because they are economical, stable, nontoxic, essentially water-insoluble, and safe.

Anhydrous calcium sulfate is most preferred over the various hydrated forms of calcium sulfate since waters of hydration should be avoided in the final grease. However, if the grease is processed at such temperatures and pressures so as to remove any water of hydration from the grease, then hydrated forms of calcium sulfate can be used without adverse effects in the final grease.

Calcium sulfate and calcium carbonate provide many unexpected surprisingly good advantages over calcium bisulfate and calcium bicarbonate. For example, calcium sulfate is essentially water-insoluble and will not be extracted from the grease if contacted with water. Calcium sulfate is also very compatible with elastomers and seals. Similarly, calcium carbonate is extremely water insoluble and will not be extracted from the grease if contacted with water. Calcium carbonate is also very compatible with elastomers and seals.

On the other hand, calcium bisulfate and calcium bicarbonate are water-soluble. When water comes into significant contact with calcium bisulfate or calcium bicarbonate, they have a tendency to leach, run, extract, and wash out of the grease. This destroys any significant antiwear and extreme pressure qualities of the grease. Calcium bisulfate and calcium bicarbonate are also protonated and have acidic hydrogen present which can adversely react, crack, degrade, and corrode seals and elastomers.

The use of both sulfates and carbonates in the additive packages produced unexpected surprisingly good results over the use of much greater amounts of either sulfates or carbonates alone. For example, the use of both sulfates and carbonates produced superior wear protection in comparison to a similar grease with a much greater amount of carbonates in the absence of sulfates, or a similar grease with a much greater amount of sulfates in the absence of carbonates.

Halogenated materials should be avoided when using the additive mixture comprising sulfates and carbonates. Halogenated materials to be avoided include halogenated hydrocarbons, particularly chlorinated paraffins. Such materials exhibit corrosive tendencies at prolonged high temperatures and thereby result in chemical attack to ferrous and non-ferrous metals. This corrosivity is greatly accelerated when water is present. Even small levels of water such as the moisture levels commonly found in air at room temperature are enough to cause catastrophic ferrous corrosion. Furthermore, the extremely large synergistic improvement in extreme pressure and antiwear properties produced by the sulfate/carbonate mixture is decreased when chlorinated paraffins are also present. Also, the National Toxicology Program (NTP) has evaluated some chlorinated paraffins and found them to exhibit clear evidence of carcinogenicity.

Furthermore, the combination of the above sulfates and carbonates achieved unexpected surprisingly good results in copper corrosion protection, even at 300° F. or 350° F., while also achieving compatibility with elastomers and seals.

The non-corrosivity of the mixture of calcium sulfate and calcium carbonate at very high temperatures is also in marked contrast to oil-soluble sulfur-containing materials.

In another form, the additive package comprises sulfates and carbonates with a minor amount of hydroxides. The preferred hydroxide is calcium hydroxide. The addition of calcium hydroxide to the sulfate/carbonate mixture imparts improved wear resistance to the grease and also provides additional overbasing to neutralize acidic materials which form over long periods of time as the grease oxidizes.

As used in this application, the term "polymer" means a molecule comprising one or more types of monomeric units chemically bonded together to provide a molecule with at least six total monomeric units. The monomeric units incorporated within the polymer may or may not be the same. If more than one type of monomer unit is present in the polymer the resulting molecule may be also referred to as a copolymer.

A more detailed explanation of the invention is provided in the following description and appended claims.

DETAILED DESCRIPTION OF THE PREFERRED EMBODIMENT

A high performance adherent, friction-reducing grease is provided which effectively lubricates the sides of railroad tracks and provides improved benefits of the range described above. The novel grease exhibits adherence, spreadability down the rail, resistance to water (rain), lowered friction at the railroad track/wheel flange interface, excellent extreme pressure and antiwear performance, non-corrosivity at high temperatures, low oil separation, good mobility and pumpability. Most significantly, the novel grease provides these beneficial properties while being completely safe and environmentally compatible with plant life and animals. The novel grease also avoids most if not all of the problems associated with prior art lubricant compositions containing graphite and/or molybdenum disulfide and conforms to EPA guidelines.

The preferred lubricating grease comprises by weight: 45% to 85% base oil, 4% to 30% extreme pressure antiwear additives, and 1% to 10% of adhesive polymer. For best result, the most preferred lubricating grease comprises by weight: at least 65% base oil, 8% to 20% extreme pressure antiwear additives, and 2% to 6% of the adhesive polymer. When the novel grease is thickened substantially by polyurea, triurea, biurea, calcium soaps (simple or complex), or aluminum soaps (simple or complex), or combinations thereof, the preferred lubricating grease comprises by weight 3% to 14% of said thickener. For best results, the most preferred lubricating grease comprises by weight 4% to 8% of said thickener. When the novel grease is thickened substantially by the interaction of the extreme pressure antiwear additives and the adhesive polymer, and when the polyurea, triurea, biurea, calcium complex soap, bentonite, or other clay-type materials, or fumed silica, or other appropriate silica materials, or combinations thereof are present as dropping point elevating additives, then the preferred lubricating grease comprises by weight 0.1 to 3% of said dropping point elevating additives. For best results, the most preferred lubricating grease comprises by weight 0.1 to 2% of said dropping point elevating additives. It should be noted that when the dropping point elevating additives are present at 0% (not present), the resulting lubricating grease is thickened entirely by the interaction of the extreme pressure antiwear additives and the adhesive polymer.

The polymeric additive cooperates and is compatible (non-interfering) with the extreme pressure antiwear additive package to provide the proper balance of railroad track retentivity, friction reduction, wear reduction, mobility, and pumpability while also maintaining an environmentally safe product.

Sulfide polymers, such as insoluble arylene sulfide polmers, should be avoided in the grease because they: (1) corrode copper, steel, and other metals, especially at high temperatures, (2) degrade, deform, and corrode silicon seals, (3) significantly diminish the tensile strength and elastomeric properties of many elastomers, (4) exhibit inferior fretting wear, and (5) are abrasive.

Sulfur compounds, such as oil-soluble sulfur compounds, can be even more aggravating, troublesome, and worse than oil-insoluble sulfur compounds. Sulfur compounds and especially oil soluble sulfur compounds should be generally avoided in the grease because they are often chemically incompatible and detrimental to silicone, polyester, and other types of elastomers and seals. Oil-soluble sulfur compounds can destroy, degrade, deform, chemically corrode, or otherwise damage elastomers and seals by significantly diminishing their tensile strength and elasticity.

Furthermore, oil-soluble sulfur compounds are extremely corrosive to copper, steel and other metals at high temperatures such as 350° F.

Generally, any sulfur-containing organic compounds should be avoided in the additive composition of the railroad track/wheel flange grease, especially the sulfurized hydrocarbons and organometallic sulfur salts. Sulfur compounds of the type to be avoided in the grease include saturated and unsaturated aliphatic as well as aromatic derivatives that have from 1 to 32 or 1 to 22 carbon atoms. Included in this group of oil soluble sulfur compounds to be avoided in the grease are alkyl sulfides and alkyl polysulfides, aromatic sulfides and aromatic polysulfides, e.g. benzyl sulfide and dibenzyl disulfide, organometallic salts of sulfur containing acids such as the metal neutralized salts of dialkyl dithiophosphoric acid, e.g. zinc dialkyl dithiophosphate, as well as phosphosulfurized hydrocarbons and sulfurized oils and fats. Sulfurized and phosphosulfurized products of polyolefins are very detrimental and should be avoided in the grease. A particularly detrimental group of sulfurized olefins or polyolefins are those prepared from aliphatic or terpenic olefins having a total of 10 to 32 carbon atoms in the molecule and such materials are generally sulfurized such that they contain from about 10 to about 60 weight percent sulfur.

The aliphatic olefins to be avoided in the grease include mixed olefins such as cracked wax, cracked petrolatum or single olefins such as tridecene-2, octadecene-1, eikosene-1 as well as polymers of aliphatic olefins having from 2 to 5 carbon atoms per monomer such as ethylene, propylene, butylene, isobutylene and pentene.

The terpenic olefins to be avoided in the grease include terpenes ($C_{10}H_{16}$), sesquiterpenes ($C_{15}H_{24}$) and diterpenes ($C_{20}H_{32}$). Of the terpenes, the monocyclic terpenes having the general formula $C_{10}H_{16}$ and their monocyclic isomers are particularly detrimental.

INHIBITORS

The additive package may be complemented by the addition of small amounts of an antioxidant and a corrosion inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl)amine, N,N diphenyl-p-phenylenediamine, 2,2,4 trimethyldihydroquinoline oligomer, bis(4 isopropylaminophenyl)-ether, N-acyl-p-aminophenol, N-acylphenothiazines, N of ethylenediamine tetraacetic acid, and alkylphenol-formaldehyde-amine polycondensates.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion. Likewise, substituted amides, imides, amidines, and imidazolines can be used to limit ferrous corrosion. Other ferrous corrosion inhibitors include certain salts of aromatic acids and polyaromatic acids, such as zinc naphthenate.

Metal deactivators can also be added to further prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines. Although such metal deactivators can be added to the grease, their presence is not normally required due to the extreme nonreactive, noncorrosive nature of the railroad track/wheel flange grease composition.

BASE OIL

The base oil can be naphthenic oil, paraffinic oil, aromatic oil, or a synthetic oil such as a polyalphaolefin polyolester, diester, polyalkyl ethers, polyaryl ethers, silicone polymer fluids, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) olefin (alkylene) oxide-type polymers, such as olefin (alkylene) oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl)siloxane and poly(methyl)phenylsiloxane.

The preferred base oil comprises about 65% by weight of a refined, solvent-extracted, hydrogenated, dewaxed base oil, preferably 850 SUS oil, and about 35% by weight of another refined solvent-extracted dewaxed base oil, preferably 150 SUS oil, for better results.

THICKENER

Thickeners useful in the novel lubricating grease include polyurea, calcium soaps (simple and complex), and aluminum soaps (simple and complex). Polyurea thickeners are preferred over other types of thickeners because they have high dropping points, typically 460° F. to 500° F., or higher. Polyurea thickeners are also advantageous because they have inherent antioxidant characteristics, work well with other antioxidants, and are compatible with all elastomers and seals.

The polyurea thickener can be prepared, if desired, by reacting an amine and a polyamine, with diisocyanate. For example, polyurea can be prepared by reacting the following components:

1. A diisocyanate or mixture of diisocyanates having the formula OCN—R—NCO, wherein R is a hydrocarbylene having from 2 to 30 carbons, preferably from 6 to 15 carbons, and most preferably 7 carbons;

2. A polyamine or mixture of polyamines having a total of 2 to 40 carbons and having the formula:

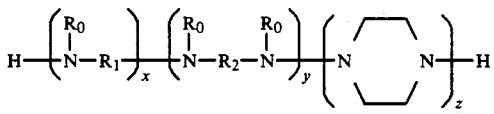

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1–C4 alkyl, and preferably hydrogen; x is an integer from 0 to 4; y is 0 or 1; and z is an integer equal to 0 when y is 1 and equal to 1 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The reaction is usually accomplished in a suitable solvent. In most cases the solvent is a portion of the base oil to be used in the final lubricating grease. The molar ratio of the reactants present can vary from 0.1–2 molar parts of monoamine or monoisocyanate and 0–2 molar parts of polyamine for each molar part of diisocyanate. When the monoamine is employed, the molar quantities can be (m+1) molar parts of diisocyanate, (m) molar parts of polyamine and 2 molar parts of monoamine. When the monoisocyanate is employed, the molar quantities can be (m) molar parts of diisocyanate, (m+1) molar parts of polyamine and 2 molar parts of monoisocyanate (m is a number from 0.1 to 10, preferably 0.2 to 3, and most preferably 1).

Mono- or polyurea compounds can have structures defined by the following general formula:

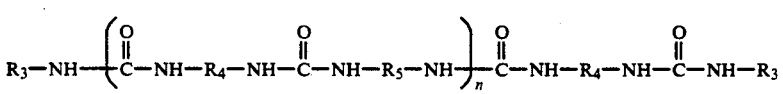

(1)

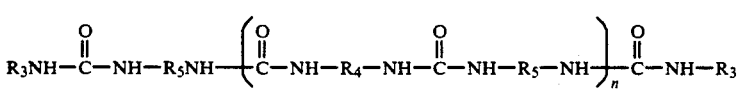

(2)

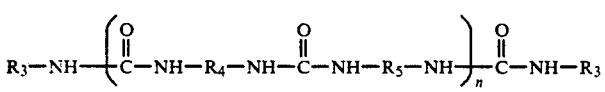

(3)

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturate (one or more double-bonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula 1 above are prepared by reacting (n+1) molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with (n+1) molar parts of a diamine and 2 molar parts of a monoisocyanate. (When n equals zero in the above Formula 2, th diisocyanate is deleted). Mono- or polyureas having the structure presented in Formula 3 above are prepared by reacting (n) molar parts of a diisocyanate with (n) molar parts of a diamine and 1 molar part of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst and is initiated by merely contacting the component reactants under conditions conducive for the reaction. Typical reaction temperatures range from 70° F. to 210° F. at atmospheric pressure. The reaction itself is exothermic and, by initiating the reaction at room temperature, elevated temperatures are obtained. External heating or cooling may be used.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadeccadienylamine, abietylamine, aniline, toluidine, naphthylamine, cumylamine, bornylamine, fenchylamine, tertiary butyl aniline, benzylamine, beta-phenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc. Unsaturated amines are particularly useful. Illustrative of monoisocyanates are: hexylisocyanate, decylisocyanate, dodecylisocyante, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

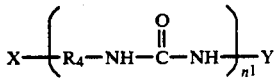

(4)

wherein $n^1$ is an integer of 1 to 3, $R_4$ is defined supra; X and Y are monovalent radicals selected from Table 1 below:

TABLE 1

| X | Y |
|---|---|
| $R_7-\overset{O}{\overset{\|}{C}}-NH-$ | $R_7-\overset{O}{\overset{\|}{C}}-NH-R_5-$ |
| 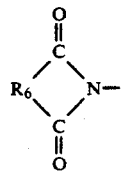 | 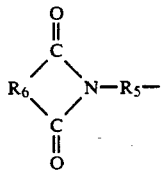 |
| | $R_8-$ |

In Table 1, $R_5$ is defined supra, $R_8$ is the same as $R_3$ and defined supra, $R_6$ is selected from the groups consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially. Usually, the reactants are mixed and reacted in a solvent to assist in facilitating a complete reaction to form the desired polyurea thickener. The solvent can, in principle, be any solvent which allows effective dispersion and mixing of the reactants as well as dispersion of the resulting polyurea. However, in most cases the solvent used is a portion of the base oil to be part of the final lubricating grease.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2) above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

The polyurea comprising the thickener can also be prepared in a pot, kettle, bin, or other vessel by reacting an amine, such as a fatty amine, with diisocyanate, or a polymerized diisocyanate, and water. In this case the polyamine (diamine in this case) is formed in situ by hydrolysis of the diisocyanate. Therefore, the chemical structure of the polyamine will be determined by the choice of diisocyanate used. When this reaction scheme is used to form the polyurea, the diisocyanates and amines useful are the same as those already given above. As already described, the reaction to form the polyurea usually takes place in a solvent. The solvent is usually a portion of the base oil to be used in the final lubricating grease.

Biurea (diurea) may be used as a thickener, but it is generally not as stable as polyurea and may shear and lose consistency when pumped. If desired, triurea can also be included with or used in lieu of polyurea or biurea.

Calcium soap thickeners may also be used, although experience in the U.S. has indicated that polyurea thickener systems, as previously described, are intrinsically superior. Calcium soap thickeners may be either simple soaps or complex soaps.

To make a calcium soap thickener requires a calcium-containing base and a fatty monocarboxylic acid, ester, amide, anhydride, or other fatty monocarboxylic acid derivative. When the two materials are reacted together, usually while slurried dispersed, or otherwise suspended in a base oil, a calcium carboxylate salt, or mixture of salts is formed in the base oil. The calcium salt or salts formed thicken the oil, thereby facilitating a grease-like texture. During the reaction, water may or may not be present to assist in the formation of thickener. In earlier calcium grease technology some added water may be retained in the final calcium soap grease as "tie water." This water is required to give permanence to the grease consistency. If the grease is heated much above 212° F., the tie water is lost, and with it the grease consistency. Such hydrous calcium greases are referred to as "cup greases," and usually do not perform well as railroad track/wheel flange greases where performance at temperatures of 300° F. are encountered.

Simple calcium soap-thickened greases do not require tie water and are referred to as anhydrous calcium soap greases. Anhydrous simple calcium soap thickeners can be useful for railroad track/wheel flange greases and can comprise a minor to a substantial portion of monocarboxylic acids or fatty acid derivatives, preferably with a hydroxyl group on one or more of the carbon atoms of the fatty chain for better stability of grease structure. The added polarity afforded by this hydroxyl group eliminates the need for tie water. Anhydrous simple calcium soap-thickened greases are best used at lower temperatures since their dropping points are usually within the range of 300° F. to 390° F.

The calcium base material used in the thickener can be calcium oxide, calcium carbonate, calcium bicarbonate, calcium hydroxide, or any other calcium containing substance which, when reacted with a monocarboxylic acid or monocarboxylic acid derivative, provides a calcium carboxylate thickener.

Desirably, monocarboxylic fatty acids or their derivatives used in simple calcium soap thickeners have a moderately high molecular weight: 7 to 30 carbon atoms, preferably 12 to 30 carbon atoms, and most preferably 18 to 22 carbon atoms, such as lauric, myristic, palmitic, stearic, behenic, myristoleic, palmitoleic, oleic, and linoleic acids. Also, vegetable or plant oils such as rapeseed, sunflower, safflower, cottonseed, palm, castor and corn oils and animal oils such as fish oil, hydrogenated fish oil, lard oil, and beef oil can be used as a source of monocarboxylic acids in simple calcium soap thickeners. Various nut oils or the fatty acids derived therefrom may also be used in simple calcium soap thickeners. Most of these oils are primarily triacylglycerides. They may be reacted directly with the calcium-containing base, or the fatty acids may be cleaved from the triglyceride backbone, separated, and then reacted with the calcium-containing base as free acids.

Hydroxy-monocarboxylic acids used in simple anhydrous calcium soap thickeners can include any counterpart to the preceding acids. The most widely used hydroxy-monocarboxylic acids are 12-hydroxystearic acid, 14-hydroxystearic acid, 16-hydroxystearic acid, 6-hydroxystearic acid and 9,10-dihydroxystearic acid. Likewise, any fatty acid derivatives containing any of the hydroxy-carboxylic acids may be used. In general, the monocarboxylic acids and hydroxy-monocarboxylic acids can be saturated or unsaturated, straight or branch chained. Esters, amides, anhydrides, or any other derivative of these monocarboxylic acids can be used in lieu of the free acids in simple anhydrous calcium soap thickeners. The preferred monocarboxylic and hydroxy-monocarboxylic acid derivative is free carboxylic acid, however, other derivatives, such as those described above, can be used depending on the grease processing conditions and the application for which the grease is to be used.

When preparing simple anhydrous calcium soap thickeners by reacting the calcium base and the monocarboxylic acid, or mixture of monocarboxylic acids or derivatives thereof, it is preferred that the calcium base be added in an amount sufficient to react with all the acids and/or acid derivatives. It is also sometimes advantageous to add an excess of calcium base to more easily facilitate a complete reaction. The amount of excess calcium base depends on the severity of processing which the base grease will experience. The longer the base grease is heated and the higher the maximum heat treatment temperature, the less excess calcium base is required. In one railroad track/wheel flange grease, a tricalcium phosphate and calcium carbonate additive system is added as preformed solids during the heat treatment step, and less excess calcium base need be added since both tricalcium phosphate and calcium carbonate are basic materials capable of reacting with monocarboxylic acids.

In simple anhydrous calcium-soap thickened greases, the thickener forming reaction is usually carried out at somewhat elevated temperatures, 150° F. to 320° F. Water may or may not be added to facilitate a better or more complete reaction. Preferably, any water added at the beginning of the processing as well as water formed from the thickener reaction is evaporated by heat, vacuum, or both. The thickener reaction is generally carried out after the addition of some base oil as previously described. After the thickener has been formed and any water removed, additional base oil can be added to the anhydrous base grease. During preparation, the base grease can be heat treated to a temperature ranging from about 250° F. to about 320° F. The concentration of base grease can be reduced with more base oil, additives, and other ingredients used to produce the finished grease product.

In addition to simple calcium soap thickener, calcium complex soap thickener can be used. Calcium complex soap thickener comprises the same two ingredients described in the simple calcium soap case, namely, a calcium-containing base and monocarboxylic acids, at least part of which should preferably be hydroxy-monocarboxylic acids. Additionally, calcium complex soap thickeners comprise a shorter chain monocarboxylic acid. Esters, amides, anhydrides, or other carboxylic acid derivatives can also be used. The short chain fatty acid in calcium complex soap greases can have from 2 to 12 carbons, preferably 2 to 10, and most preferably 2 to 6. While the short chain acid in calcium complex soap thickener can be alkyl or aryl, unsaturated or saturated, straight chain or branched, alkyl, straight chain, saturated acids are preferred, such as acetic acid, due to its low cost and availability. Propionic acid can also be used with similar results. Butyric, valeric, and caproic acids can be used, but are not preferred in part because of their offensive odors.

In calcium complex soap thickeners, the ratio of short chain acids to long chain acids can vary widely depending on the desired grease yield and dropping point. The lower the ratio of short chain acids to long chain acids, the less will be the dropping point elevation above that of a simple, anhydrous calcium soap grease. The larger the ratio of short chain acid to long chain acid, however, the poorer the grease yield because of the less effective thickening power of the calcium salt of the short chain carboxylic acid.

Processing conditions for manufacture of calcium complex greases are similar to those described for simple calcium greases. An amount of the calcium base is slurried in some of the base oil. Then the long chain monocarboxylic acids and short chain carboxylic acids are added. They may be added together or separately. Water may or may not also be added. If water is added to the thickener, then the water is preferably vaporized or otherwise removed after the thickener has been formed. This can be accomplished by heat, vacuum, or both. Once formed and dried, the calcium complex base grease can be conditioned with a heat treatment step, such as by heating the grease to a temperature ranging from about 250° F. to about 400° F., preferably, to at least about 300° F.

Other types of thickener systems which may be of utility include aluminum soap thickeners. As with the previously described calcium soap thickeners, aluminum soap thickeners may be simple or complex.

The major difference between the previously described calcium soap thickeners and the aluminum soap thickeners is the basic metallic source used. Aluminum soap thickeners are generally made using basic aluminum sources such as aluminum alkoxides. One particularly useful material is aluminum isopropoxide. In theory, aluminum hydroxide and aluminum oxide are applicable. However, in practice, it has generally been found that these materials are less reactive towards acids and accordingly are usually not used. Other aluminum sources include specialty chemicals designed to react with acids and/or water to produce the desired aluminum soap thickeners. Such materials include a material sold under the brand name of Tri-XL by R. T. Vanderbilt Co. Other aluminum-containing sources can also be used. The only requirement is that the source of aluminum react with the other involved reagents to form the desired aluminum soap thickener. For instance, a more reactive metal base such as sodium hydroxide can be reacted with the proper aliphatic monocarboxylic acid to produce the sodium aliphatic monocarboxylic acid salt. Then metathesis with an aluminum salt such as aluminum nitrate or aluminum sulfate will produce the desired aluminum soap thickener.

The relative stoichiometric amount of aluminum base to monocarboxylic acid can vary depending on the rheological properties desired in the final thickener. Generally, aluminum monocarboxylates will give superior thickening and gel strengths compared to aluminum tricarboxylates. Aluminum dicarboxylates have been found to be intermediate in such respects.

The aliphatic monocarboxylic acids used to manufacture simple aluminum soap thickeners are the same as those described above for calcium soap thickeners and their description shall not be repeated here.

The additional acids used to produce aluminum complex thickeners, the so-called complexing acids, can be selected from the same group described above in the section on calcium complex soap thickeners. However, the preferred acids are, in common practice, somewhat different than those described in the previous section on calcium complex soap thickeners. Preferably, the complexing acids used to form aluminum complex soap thickeners are acids which contain at least one aryl ring. Most preferably, the complexing acids used have one to three carbon atoms not included in the aryl ring. While these aryl acids may contain more than one carboxylic acid group per molecule, one carboxylic acid group per molecule is most preferred. The acidic group in the complexing acid need not be carboxylic. Sulfonic acids group and acidic phenol groups may also be used.

When forming aluminum complex soap thickeners, at least two of the three valences of the aluminum should be satisfied by the acid moieties, at least one of which should be the derived from the complexing acid. Most preferably, two of the three aluminum valences are satisfied by one each of monoaliphatic carboxylate and aryl carboxylate with the third valence satisfied by hydroxide.

Aluminum soap thickeners, both simple and complex are formed by processes similar to those described above for calcium soap thickeners. Water is generally present as a reaction media, and if aluminum alkoxides are used, the water is also a reactant. Reaction by-products such as water and alkyl alcohols are volatilized off by heat, vacuum, or both heat and vacuum. Reaction conditions are similar to those described above for simple and complex calcium soap thickeners.

Combinations of polyurea with one or more of the soap thickeners previously described may also be used.

ADDITIVES

In order to attain extreme pressure properties, antiwear qualities, and friction reduction properties, as well as any elastomeric compatibility which may be required, the additives in the additive package comprise, in one form, tricalcium phosphate and calcium carbonate, preferably in the absence of sulfur compounds.

Preferably, the tricalcium phosphate and the calcium carbonate are each present in the additive package in an amount ranging from 2% to 15% by weight of the grease. For ease of handling and manufacture, the tricalcium phosphate and calcium carbonate are each most preferably present in the additive package in an amount ranging from 4% to 10% by weight of the grease.

Desirably, the maximum particle sizes of the tricalcium phosphate and the calcium carbonate are 100 microns and the tricalcium phosphate and the calcium carbonate are of food-grade quality to minimize abrasive contaminants and promote homogenization. Calcium carbonate can be provided in dry solid form as $CaCO_3$. Tricalcium phosphate can be provided in dry solid form as $Ca_3(PO_4)2$ or $3Ca_3(PO_4)_2 .Ca(OH)_2$.

If desired, the calcium carbonate and/or tricalcium phosphate can be added, formed, or created in situ in the grease as by-products of chemical reactions. For example, calcium carbonate can be produced by bubbling carbon dioxide through calcium hydroxide in the grease. Tricalcium phosphate can be produced by reacting phosphoric acid with calcium oxide or calcium hydroxide in the grease. Other methods for forming calcium carbonate and/or tricalcium phosphate can also be used.

The preferred phosphate additive is tricalcium phosphate for best results. While tricalcium phosphate is preferred, other phosphate additives can be used, if desired, in conjunction with or in lieu of tricalcium phosphate, such as the phosphates of a Group 2a alkaline earth metal, such as beryllium, magnesium, calcium, strontium, and barium, or the phosphates of a Group 1a alkali metal, such as lithium, sodium, and potassium.

Desirably, tricalcium phosphate is less expensive, less toxic, more readily available, safer, and more stable than other phosphates. Tricalcium phosphate is also superior to monocalcium phosphate and dicalcium phosphate. Tricalcium phosphate has unexpectedly been found to be noncorrosive to metals and compatible with elastomers and seals. Tricalcium phosphate is also water-insoluble and will not wash out of the grease when contamination by water occurs. Monocalcium phosphate and dicalcium phosphate, however, have acidic protons which at high temperatures can corrosively attack metal surfaces. Monocalcium phosphate and dicalcium phosphate were also found to corrode, crack, and/or degrade some elastomers and seals. Monocalcium phosphate and dicalcium phosphate were also undesirably found to be water soluble and can wash out of the grease when exposed to water, which would significantly decrease the antiwear and extreme pressure qualities of the grease.

The preferred carbonate additive is calcium carbonate for best results. While calcium carbonate is preferred, other carbonate additives can be used, if desired, in conjunction with or in lieu of calcium carbonate, such as the carbonates of Group 2a alkaline earth metal, such as beryllium, magnesium, calcium, strontium, and barium, or the carbonates of a Group 1a alkali metal, such as lithium, sodium, and potassium.

Desirably, calcium carbonate is less expensive, less toxic, more readily available, safer, and more stable than other carbonates. Calcium carbonate is also superior to calcium bicarbonate. Calcium carbonate has been unexpectedly found to be non-corrosive to metals and compatible to elastomers and seals. Calcium carbonate is also water insoluble. Calcium bicarbonate, however, has an acidic proton which at high temperatures can corrosively attack metal surfaces. Also, calcium bicarbonate has been found to corrode, crack, and/or degrade many elastomers and seals. Calcium bicarbonate has also been undesirably found to be water soluble and experiences many of the same problems as monocalcium phosphate and dicalcium phosphate discussed above.

The use of both tricalcium phosphate and calcium carbonate together in the extreme pressure antiwear (wear-resistant) additive package of the novel grease was found to produce unexpected superior results.

If desired, in lieu of tricalcium phosphate, calcium sulfate can be used in combination with calcium carbonate. Preferably, the calcium sulfate and calcium carbonate are each present in the additive package in an amount ranging from 2% to 15% by weight of the grease. For ease of handling and manufacture, the calcium sulfate and calcium carbonate are each most preferably present in the additive package in an amount ranging from 4% to 10% by weight of the grease.

If desired, the calcium carbonate and/or calcium sulfate can be added, formed, or created in situ in the grease as by-products of chemical reactions. For example, calcium carbonate can be produced by bubbling carbon dioxide through calcium hydroxide in the grease. Calcium sulfate can be produced by reacting sulfuric acid with calcium oxide or calcium hydroxide in the grease. Other methods for forming calcium carbonate and/or calcium sulfate can also be used.

The preferred sulfate additive is anhydrous calcium sulfate for best results. While calcium sulfate is the preferred, other sulfate additives can be used, if desired, in conjunction with or in lieu of calcium sulfate, such as the sulfates of Group 2a alkaline earth metal, such as beryllium, magnesium, calcium, strontium, and barium, or the sulfates of a Group a1 alkali metal, such as lithium, sodium, and potassium.

Desirably, calcium sulfate is less expensive, less toxic, more readily available, and safer. Calcium sulfate is also superior to calcium bisulfate. Calcium sulfate is also essentially water insoluble and will not wash out of the grease when contamination by water occurs.

The calcium sulfate and calcium carbonate additive package can further comprise calcium hydroxide. It has been found that a relatively minor level of calcium hydroxide, when added to the grease, improves the wear resistance properties. Also, the calcium hydroxide provides additional excess alkaline reserve which can be useful to help neutralize any acidic products which may result from high temperature oxidation of the grease over long periods of time. Preferably, the calcium hydroxide, when present, should be present at 0.01% to 5% by weight of the grease. For best results, the calcium hydroxide, when present, should be present at 0.1% to 2% by weight of the grease. Calcium hydroxide may be provided as $Ca(OH)_2$. If desired, the calcium hydroxide can be produced, formed, or created in situ in the grease as by-products of chemical reactions designed to produce calcium hydroxide.

The use of both calcium sulfate and calcium carbonate together in the additive package of the grease was found to produce unexpected superior results in comparison to a similar grease with greater amount by weight of: (a) calcium sulfate alone in the absence of calcium carbonate, or (b) calcium carbonate alone in the absence of calcium sulfate.

POLYMERS

It has been unexpectedly and surprisingly found that the polymeric additives comprising the polymers described below, in the absence of organically bonded sulfur, when used in the presence of and in combination and conjunction with the above described extreme pressure antiwear additives and preferably with the below described boron-containing material, imparts requisite retentivity-related properties i.e. adhesion to the rail side, spreadability down the rail, effectiveness during the passing of several trains, resistance to removal by water as well as preserving the extreme pressure antiwear and friction reducing properties of the grease. Furthermore, is has been most unexpectedly and surprisingly found that permanent and stable greases can be formed when only a minor portion or even zero thickener is present. This is apparently due to an interaction between the extreme pressure antiwear additives and polymeric additives. Advantageously, such polymers are hydrophobic to assist in imparting resistance to removal by exposure to rain water once applied to to the rail. The polymers should have reasonably good thermal and oxidative stability so as to not degrade during the transient high temperatures encountered on the rail side during passage of a train. Polymers containing organically bonded sulfur should be avoided due to their high temperature corrosive nature.

Polymers which are applicable for use in railroad track/wheel flange greases to attain the desired characteristics described above desirably have molecular weights in the range from about 1,000 to about 25,000,000 or more. Preferably, at least a substantial portion of polymer should have a molecular weight between 10,000 and 5,000,000. For best results, a substantial portion of the polymer should have a molecular weight between 50,000 and 200,000.

Acceptable polymers for attaining many of the grease characteristics described above include: polyolesters (polyesters), polyamides, polyurethanes, polyoxides, polyamines, polyacrylamide, polyvinyl alcohol, ethylene vinyl acetate, and polyvinyl pyrrolidone. Other acceptable polymers include: polyolefins (polyalkylenes), such as polyethylene, polypropylene, polyisobutylene, ethylene propylene copolymers, or ethylene butylene copolymers; or polyolefin (polyalkylene) arylene copolymers, such as ethylene styrene copolymers and styrene isoprene copolymers; polyarylene polymers, such as polystyrene; acrylate or methacrylate polymers or copolymers. Copolymers with monomeric units comprising the monomeric units of the preceding polymers and combinations thereof may also be used. Also, boronated polymers or boronated compounds comprising the borated or boronated analogs of the preceding polymers (i.e., any of the preceding polymers reacted with boric acid, boric oxides, or boron inorganic oxygenated material) may also be used when nucleophilic sites are available for boration.

For better results, the preferred polymers include at least a substantial portion of a polymer containing as a monomeric unit an alkenyl substituted aryl group such as styrene.

For best results, the most preferred polymers include at least a substantial portion of a polymer containing as monomeric units an aryl substituted alkenyl group such as styrene as well as a non-aryl substituted alkenyl group such as ethylene, propylene, butene, butadiene, or isoprene. Particularly preferred among this group is the styrene-isoprene copolymer Shellvis 40, having a molecular weight of about 150,000 and sold by Shell Chemical Company.

BORATES

In any of the above described forms of the novel lubricating grease, boron-containing oil separation inhibitors can be optionally added. It was found that borates or boron-containing materials such as borated amine, when used in polyurea greases in the presence of calcium phosphates and calcium carbonates, act as an oil separation inhibitor, which is especially useful at high temperatures.

Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company.

Other useful borates include borates of Group 1a alkali metals, borates of Group 2a alkaline earth metals, stable borates of transition metals (elements), such as zinc, copper, and tin, boric oxide, and combinations of the above.

These borated materials may also be used when soap thickeners or mixtures of polyurea and soap thickeners are used.

When boron-containing oil separation inhibitors are used in the novel grease they should be present at 0.01% to 10%, preferably 0.1% to 5%, and most preferably 0.25% to 2.5%, by weight of the boron-containing material in the total grease.

It was also found that borated inhibitors minimized oil separation even when temperatures were increased from 210° F. to 300° F. or 350° F. Advantageously, borated inhibitors restrict oil separation over a wide temperature range. This is in direct contrast to the traditional oil separation inhibitors, such as high molecular weight polymer inhibitors such as that sold under the brand name of Paratac by Exxon Chemical Company U.S.A. As already discussed above, polymeric additives can impart an adhesive, stringy, or tacky texture to the lubricating grease because of the extremely high viscosity and long length of their molecules. As the temperature of the grease is raised, the viscosity of the polymeric additive within the grease is substantially reduced as is its tackiness. Tackiness restricts oil bleed. As the tackiness is reduced, the beneficial effect on oil separation is also reduced. Borated amine additives do not behave in this way since their effectiveness does not depend on imparted tackiness. Borated amines do not cause the lubricating grease to become adhesive, tacky, or stringy. This is desirable since it provides the lubricant formulator with the means to separately control the high temperature oil separation properties and the adhesive, tacky texture.

It is believed that borated amines chemically interact with the tricalcium phosphate and/or calcium carbonate in the grease. The resulting species then interacts with the polyurea thickener system in the grease to form an intricate, complex system which effectively binds the lubricating oil.

Inorganic borate salts, such as potassium triborate, provide an oil separation inhibiting effect similar to borated amines when used in polyurea greases in which calcium phosphate and calcium carbonate are also present. It is believed that the physio-chemical reason for this oil separation inhibiting effect is similar to that for borated amines.

The following Examples are for purposes of illustrating the novel adhesive, friction reducing greases and should not be used for purposes of limiting the scope of the invention as provided in the appended claims. Example 1 below describes the preparation of a polyurea base grease.

EXAMPLE 1

To a laboratory grease kettle was charged 34.00 pounds of a solvent-extracted, hydrotreated, paraffinic mineral oil having a viscosity of about 850 SUS at 100° F. The oil was stirred and heated until the temperature reached 170° F. Then 7.49 pounds of fatty amine sold under the brand name of Armeen T by Akzo Chemicals, Inc. was added to the kettle where it melted and mixed well with the 850 SUS oil. Then 3,500 milliliters of water was added to the kettle and the contents stirred well while heating back to 170° F. A 8.51 pound charge of Isonate 143L, a diisocyanate blend sold by Dow Chemical Company and containing predominantly 4,4'-diphenylmethane diisocyanate, was added and the kettle was closed.

The contents of the kettle were stirred for 90 minutes while maintaining the temperature around 190° F. The hot heat transfer fluid was circulated through the kettle jacket to provide heating to the kettle contents. The polyurea base grease in the kettle was heated to 370° F. under sealed and pressurized conditions. During the heating step, the internal pressure was partially vented several times to maintain a pressure of 75 to 82 psi. Venting was accomplished via a valved port in the top of the kettle lid. When 307° F. was reached, the pressure was vented to atmospheric and the kettle was opened. During final venting, the temperature of the grease dropped to 230° F.

Upon inspection, the grease appeared to still contain some water, so the kettle was closed and the contents were heated under vacuum back to 309° F. The vacuum was then released, the kettle was opened, and 25.00 pounds were removed and stored for other uses. The remaining polyurea base grease was heated to 395° F. while maintaining a nitrogen blanket over it. During this heating step, 11.37 pounds of a solvent-extracted, hydrotreated, paraffinic mineral oil having a viscosity of 350 SUS at 100° F. was slowly added to base grease while continually stirring. The polyurea base grease was held at 395° F. for 15 minutes, cooled to 200° F., and removed and stored for later use. The final composition of the polyurea base grease was:

| Component | % (wt) |
|---|---|
| 850 SUS Oil | 46.74 |
| 350 SUS Oil | 31.26 |
| Polyurea | 22.00 |

The following Example 2 illustrates the preparation of a typical calcium complex base grease.

EXAMPLE 2

To a laboratory grease kettle was added 16.13 pounds an 850 SUS oil similar to that used in Example 1. Then 1,013.7 grams of hydrated lime (calcium hydroxide) was added and stirred well to produce a smooth slurry. The slurry was then heated to 140° F. by addition of steam to the kettle jacket. When 140° F. was reached, 616.85 grams of 12-hydroxystearic acid and 1,822.61 grams of hydrogenated fatty acids were added and the temperature was increased to 170° F. The kettle contents were stirred for 30 minutes during which time a grease structure formed. Then 1,038.14 grams of glacial acetic acid was added and allowed to react without additional applied heat for 30 minutes. The kettle was then heated with full jacket steam while continuing to stir the calcium complex base grease.

When the temperature reached 240° F., electrical heating units in the kettle walls were energized with 40 amperes and heating was continued until the temperature reached 280° F. The kettle was then sealed and a vacuum was applied. The electrical heaters were boosted to 90 amperes and the kettle contents were stirred for one-half hour. Then the vacuum was released and the kettle was opened. The temperature of the calcium complex grease was 310° F. Additional 850 SUS oil was slowly admixed to the calcium complex base grease. When all the oil was in and well mixed, the grease was heated to 390° F. under a nitrogen blanket, removed, and stored. The final composition of the calcium complex base grease was:

| Component | % (wt) |
|---|---|
| 850 SUS Oil | 75.86 |
| Calcium Complex Soap | 24.00 |
| Excess Calcium Hydroxide | 0.14 |

The following Example 3 illustrates the preparation of a typical aluminum complex base grease.

EXAMPLE 3

An aluminum complex base grease was made by the following procedure. To a 4,000 ml pyrex beaker was added 850.0 grams of 850 SUS Oil. The Oil was stirred by an overhead rotary paddle stirrer and heated by an electric laboratory hot plate. The temperature of the oil was maintained at 180° F. Stearic acid in an amount of 95.14 grams was added to the oil and stirred until it had melted. To the resulting homogenous mixture was then added 40.82 grams of benzoic acid. The mixture was then stirred for 35 minutes until the benzoic acid had dissolved. Care was taken to keep the temperature near 180° F., thereby preventing significant sublimation of the benzoic acid. Once a homogenous mixture was obtained, 68.32 grams of reagent grade aluminum isopropoxide was added and the reaction was allowed to proceed for 40 minutes while maintaining the temperature near 180° F. When no further isopropyl alcohol was being evolved, 15 ml of distilled water was added and the mixture was allowed to further react at 196° F. In the following 3–5 minutes the mixture changed from a soft, grease-like fluid to a very firm, translucent grease. To increase the pliability of the grease 153.85 grams of 850 SUS oil was added and allowed to mix into the grease. This reduced the thickener content from 15% to 13%. The resulting base grease was then stirred and heated to 300° F. to assure complete reaction of thickener components and volatilizing of reaction by-products. The base grease was then removed and stored.

The following Examples 4–14 illustrate the surprising and unexpected performance of tricalcium phosphate and calcium carbonate as an extreme pressure antiwear additive package.

EXAMPLE 4

This test served as the control for subsequent tests. A base grease was formulated with about 15% by weight polyurea thickener and about 85% by weight paraffinic solvent extracted base oil. The polyurea thickener was prepared in a vessel in a manner similar to Example 1. The paraffinic solvent extracted base oil was mixed with the polyurea thickener until a homogeneous base grease was obtained. No additive package was added to the base grease. Neither tricalcium phosphate nor calcium carbonate were present in the base grease. The EP (extreme pressure)/antiwear properties of the base grease, comprising the last nonseizure load, weld load, and load wear index were measured using the Four Ball EP method as described in ASTM D2596. The results were as follows:

| | |
|---|---|
| Last nonseizure load, kg | 32 |
| Weld load, kg | 100 |
| Load wear index | 16.8 |

EXAMPLE 5

A grease was prepared in a manner similar to Example 4, except that about 5% by weight of finely divided, precipitated tricalcium phosphate with an average mean diameter of less than 2 microns was added to the base grease. The resultant mixture was mixed and milled in a roll mill until a homogeneous grease was produced. The Four Ball EP Test showed that the EP/antiwear properties of the grease were significantly increased with tricalcium phosphate.

| | |
|---|---|
| Last nonseizure load, kg | 63 |
| Weld load, kg | 160 |
| Load wear index | 33.1 |

EXAMPLE 6

A grease was prepared in a manner similar to Example 5, except that about 10% by weight tricalcium phosphate was added to the base grease. The Four Ball EP Test showed that the EP/antiwear properties were further increased with more tricalcium phosphate.

| | |
|---|---|
| Last nonseizure load, kg | 80 |
| Weld load, kg | 250 |
| Load wear index | 44.4 |

EXAMPLE 7

A grease was prepared in a manner similar to Example 6, except that about 20% by weight tricalcium phosphate was added to the base grease. The Four Ball EP Test showed that the EP/antiwear properties of the grease were somewhat better than the 5% tricalcium phosphate grease of Example 5, but not as good as the 10% tricalcium phosphate grease of Example 6.

| | |
|---|---|
| Last nonseizure load, kg | 63 |
| Weld load, kg | 250 |
| Load wear index | 36.8 |

EXAMPLE 8

A grease was prepared in a manner similar to Example 4, except that about 5% by weight of finely divided precipitated tricalcium phosphate and about 5% by weight of finely divided calcium carbonate were added to the base grease. The tricalcium phosphate and calcium carbonate had an average mean particle diameter of less than 2 microns. The resultant grease was mixed and milled until it was homogeneous. The Four Ball EP Test showed that the EP/antiwear properties of the grease were surprisingly better than the base grease of Example 2 and the tricalcium phosphate greases of Examples 5–7.

| | |
|---|---|
| Last nonseizure load, kg | 80 |
| Weld load, kg | 400 |
| Load wear index | 52.9 |

EXAMPLE 9

A grease was prepared in a manner similar to Example 8, except that 10% by weight tricalcium phosphate and 10% by weight calcium carbonate were added to the base grease. The Four Ball EP Test showed that the weld load was slightly lower and the load wear index was slightly better than the grease of Example 8.

| | |
|---|---|
| Last nonseizure load, kg | 80 |
| Weld load, kg | 315 |
| Load wear index | 55.7 |

EXAMPLE 10

A grease was prepared in a manner similar to Example 9, except that 20% by weight tricalcium phosphate and 20% calcium carbonate were blended into the base grease. The Four Ball EP Test showed that the EP/antiwear properties of the grease were better than greases of Examples 8 and 9.

| | |
|---|---|
| Last nonseizure load, kg | 100 |
| Weld load, kg | 500 |
| Load wear index | 85.6 |

EXAMPLE 11

A grease was prepared in a manner similar to Example 4, except that about 10% by weight of finely divided calcium carbonate with a mean particle diameter of less than 2 microns was added to the base grease. The resultant grease was mixed and milled until it was homogeneous. The Four Ball EP Test showed that the weld load and load wear index of the calcium carbonate grease were better than the base grease of Example 4.

| | |
|---|---|
| Last nonseizure load, kg | 80 |
| Weld load, kg | 400 |
| Load wear index | 57 |

EXAMPLE 12

A grease was prepared in a manner similar to Example 8, except that about 3% by weight tricalcium phosphate and about 5% by weight calcium carbonate were added to the base grease. The Four Ball EP Test showed that the weld load and load wear index of the grease were better than the greases of Example 6 (10% tricalcium phosphate alone) and Example 11 (10% calcium carbonate alone), even though the total combined level of additives was only 8%. This result is most surprising and unexpected. It illustrates how the two additives can work together to give the surprising improvements and beneficial results.

| | |
|---|---|
| Last nonseizure load, kg | 80 |
| Weld load, kg | 500 |
| Load wear index | 61.8 |

EXAMPLE 13

The grease of Example 8 (5% by weight tricalcium phosphate and 5% by weight calcium carbonate) was subjected to the ASTM D4048 Copper Corrosion Test at a temperature of 300° F. for 24 hours. No significant corrosion appeared. The copper test sample remained bright and shiny. The copper strip was rated 1a.

EXAMPLE 14

The grease of Example 12 (3% by weight tricalcium phosphate and about 5% by weight calcium carbonate) was subjected to the ASTM D4048 Copper Corrosion Test at a temperature of 300° F. for 24 hours. The results were similar to Example 13.

The following Examples 15–32 illustrate the surprising and unexpected performance of calcium sulfate and calcium carbonate as an extreme pressure antiwear additive package.

EXAMPLE 15

A grease was prepared in a manner similar to the control grease of Example 4, except that about 2% by weight of finely divided calcium sulfate with an average mean diameter of less than 3.75–4.40 microns was added to the base grease. The resultant mixture was mixed and milled in a roll mill until a homogeneous grease was produced. The Four Ball EP Test showed that the EP/antiwear properties of the grease were significantly increased with calcium sulfate.

| | |
|---|---|
| Last nonseizure load, kg | 40 |
| Weld load, kg | 200 |
| Load wear index | 31.0 |

EXAMPLE 16

A grease was prepared in a manner similar to Example 15, except that about 5% by weight of finely divided, calcium sulfate was added to the base grease. The resultant mixture was mixed and milled in a roll mill until a homogeneous grease was produced. The Four Ball EP Test showed that the EP/antiwear properties of the grease were further increased with calcium sulfate.

| | |
|---|---|
| Last nonseizure load, kg | 80 |
| Weld load, kg | 250 |
| Load wear index | 42.5 |

EXAMPLE 17

A grease was prepared in a manner similar to Example 16, except that about 10% by weight calcium sulfate was added to the base grease. The Four Ball EP Test showed that the EP/antiwear properties were further increased with more calcium sulfate.

| | |
|---|---|
| Last nonseizure load, kg | 63 |
| Weld load, kg | 315 |
| Load wear index | 48.6 |

EXAMPLE 18

A grease was prepared in a manner similar to Example 17, except that about 15% by weight calcium sulfate was added to the base grease. The Four Ball EP Test showed that the EP/antiwear properties of the grease were further increased.

| | |
|---|---|
| Last nonseizure load, kg | 63 |
| Weld load, kg | 400 |
| Load wear index | 63.6 |

EXAMPLE 19

A grease was prepared in a manner similar to Example 18, except that about 20% by weight calcium sulfate was added to the base grease. The Four Ball EP Test showed that the load wear index of the grease was somewhat better than the 15% calcium sulfate grease of Example 18, but the last nonseizure load had dropped significantly.

| | |
|---|---|
| Last nonseizure load, kg | 20 |
| Weld load, kg | 400 |
| Load wear index | 65.3 |

EXAMPLE 20

A grease was prepared in a manner similar to Example 18, except that about 15% by weight of finely divided calcium carbonate was added to the base grease. The resultant grease was mixed and milled until it was homogeneous. The Four Ball EP Test showed little improvement over the grease of Example 18.

| | |
|---|---|
| Last nonseizure load, kg | 80 |
| Weld load, kg | 400 |
| Load wear index | 66.9 |

EXAMPLE 21

A grease was prepared in a manner similar to Example 20, except that about 20% by weight of finely divided calcium carbonate was added to the base grease. The resultant grease was mixed and milled until it was homogeneous. The Four Ball EP Test showed little improvement over the grease of Example 20.

| | |
|---|---|
| Last nonseizure load, kg | 80 |
| Weld load, kg | 400 |
| Load wear index | 67.1 |

EXAMPLE 22

A grease was prepared in a manner similar to Example 4, except that about 5% by weight of finely divided calcium sulfate and about 5% by weight of finely divided calcium carbonate were added to the base grease. The calcium sulfate had a mean particle diameter of 3.75–4.40 microns and the calcium carbonate had an average mean particle diameter less than 2 microns. The resultant grease was mixed and milled until it was homogeneous. The Four Ball EP Test showed that the EP/antiwear properties of the grease were surprisingly better than the base grease of Example 4, the grease of Example 11, and the greases of Examples 15–21.

| | |
|---|---|
| Last nonseizure load, kg | 80 |
| Weld load, kg | 800 |
| Load wear index | 133.4 |

The results of Example 22 are extremely surprising and unexpected. Even though the grease of Example 22 had 5% each of calcium sulfate and calcium carbonate, it demonstrated far superior EP/antiwear properties than greases with 10%, or 15%, or even 20% of either calcium sulfate alone or calcium carbonate alone.

The grease of Example 22 was subjected to a steel strip corrosion test. This test is similar to the ASTM D4048 Copper Strip Corrosion Test except that a polished steel strip is used instead of a polished copper strip. The test was performed at 300° F. for 24 hours after which time the jar of grease with the immersed steel strip was removed and allowed to cool. Then the steel strip was removed from the jar and the excess grease was removed from the steel strip by gentle blotting with a laboratory tissue paper followed by washing with a stream of heptane from a plastic squirt bottle. The steel strip had not changed its appearance. It was still shiny and polished. The steel strip was placed on a clean laboratory tissue paper and allowed to sit over night for 16 hours in the laboratory. The next morning it was still shiny and polished with no change in its appearance.

EXAMPLES 23-25

To further determine the magnitude of this synergism, three more greases were made in a manner similar to Example 22 but with lower levels of both calcium sulfate and calcium carbonate than that of Example 22. Compositions and Four Ball EP Test results are tabulated below.

| | Example Number | | |
|---|---|---|---|
| | 23 | 24 | 25 |
| Calcium sulfate, % wt | 4.0 | 3.0 | 2.0 |
| Calcium carbonate, % wt | 4.0 | 3.0 | 2.0 |
| Last nonseizure load, kg | 63 | 32 | 80 |
| Weld load, kg | 800 | 800 | 500 |
| Load wear index | 97.0 | 100.4 | 59.3 |

These results are even more surprising and unexpected than those of Example 22. Even when only 2% each of calcium sulfate and calcium carbonate was used, test results were superior to that obtained with test greases containing 10% of calcium sulfate alone or 10% of calcium carbonate alone. When 3% each of calcium sulfate and calcium carbonate was used, test results were superior to that obtained with test greases containing 10%, or 15%, or even 20% of either calcium sulfate alone or calcium carbonate alone.

EXAMPLES 26-29

To further define the remarkable synergism of calcium sulfate and calcium carbonate, several more samples were made in a manner similar to that of Example 22. The combined levels of calcium sulfate and calcium carbonate were maintained at 10% for all these samples. Compositions and Four Ball EP Test data are tabulated below:

| | Example Number | | | |
|---|---|---|---|---|
| | 26 | 27 | 28 | 29 |
| Calcium sulfate, % wt | 8.0 | 6.0 | 4.0 | 2.0 |
| Calcium carbonate, % wt | 2.0 | 4.0 | 6.0 | 8.0 |
| Last nonseizure load, kg | 80 | 80 | 80 | 80 |
| Weld load, kg | 500 | 800 | 620 | 620 |
| Load wear index | 67.7 | 100.5 | 86.1 | 83.7 |

The test data of Examples 26-29 as well as the test data of Examples 11, 17, and 22 define the synergistic interaction of calcium sulfate and calcium carbonate with respect to EP/antiwear properties.

EXAMPLES 30-31

Two greases were made in a manner similar to that of Example 24 except that 1.0% Nasul BSN by weight of the grease and 0.2% Vanlube 848 by weight of the grease were added to each of the two greases. Nasul BSN is a barium dinonylnaphthalenesulfonate additive and is available from King Industries, Inc. Vanlube 848 is an octylated diphenylamine antioxidant available from R. T. Vanderbilt Company, Inc. The second grease also had 0.5% calcium hydroxide by weight of the grease. The greases were subjected to the ASTM D2266 Four Ball Wear Test. The second grease which contained the additional minor amount of calcium hydroxide gave results superior to that of the first grease which contained no added calcium hydroxide.

| | Example Number | |
|---|---|---|
| | 30 | 31 |
| Calcium Hydroxide, % (wt) | 0 | 0.5 |
| Four Ball Wear, ASTM D2266 at 40 kg, 1200 rpm for 1 hr | 0.53 | 0.44 |

EXAMPLE 32

A grease was prepared in a manner similar to Example 22 (containing 5% calcium sulfate and 5% calcium carbonate) except that 1% of Cereclor 63L, a chlorinated paraffin containing 63% chlorine, was also added to the grease. The resulting grease was subjected to the Four Ball EP Test and gave a load wear index lower than that of Example 22.

| | |
|---|---|
| Last nonseizure load, kg | 80 |
| Weld load, kg | 800 |
| Load wear index | 107.7 |

The grease of Example 22 was subjected to a steel strip corrosion test described in Example 22. The steel strip showed very obvious signs of chemical attack. Etching pitting and a dark brown deposition covered the steel strip. The strip was placed on a clean laboratory tissue paper and allowed to sit over night for 16 hours in the laboratory. The next morning the steel strip was covered with a thick layer of rust. This rusting had occurred from the moisture content of the air and was catalyzed by residual iron chloride which had formed on the steel strip surface. This residual iron chloride had formed during the test from the dehydrohalogenation and/or dechlorination of the chlorinated paraffin additive and concomitant reaction of hydrogen chloride and/or chlorine with the steel surface.

EXAMPLES 33-34

Two railroad track/wheel flange greases are prepared as follows. A polyurea base grease was prepared in a manner similar to that of Example 1. Two portions of the base grease were separately processed in a grease kettle by heating and stirring to 300° F. and adding the following additives: tricalcium phosphate; calcium carbonate; Shellvis 40, a styrene-isoprene copolymer available from Shell Chemical Company. Each of the two additized greases were then cyclically milled at 280° F. using a rotating knife blade mill. Each of the two additized greases were then cooled to 180° F. and finished with additional 850 SUS oil, 350 SUS oil, and the following additives: Lubrizol 5391, a borated amine available from the Lubrizol Corporation; Vanlube 848, an octylated diphenylamine antioxidant available from R. T. Vanderbilt Company, Inc; Nasul BSN, a barium dinonylnaphthenate additive available from King Industries, Inc. Finally, each of the two greases were milled at 7,000 psi using a Gaulin homogenizer. The two greases had the following compositions:

| Test Grease Component, % (wt) | Ex. 33 | Ex. 34 |
|---|---|---|
| 850 SUS Oil | 56.39 | 54.46 |
| 350 SUS Oil | 28.41 | 27.44 |
| Polyurea Thickener | 8.00 | 8.00 |
| Tricalcium Phosphate | 2.00 | 3.20 |
| Calcium Carbonate | 2.00 | 3.20 |

-continued

| Test Grease Component, % (wt) | Ex. 33 | Ex. 34 |
|---|---|---|
| Shellvis 40 | 2.00 | 3.20 |
| Nasul BSN | 1.00 | — |
| Lubrizol 5391 | — | 0.30 |
| Vanlube 848 | 0.20 | 0.20 |

The grease was tested and had the following performance properties:

| | | |
|---|---|---|
| Worked Penetration, ASTM D217 | 391 | 357 |
| Dropping Point, °F., ASTM D2265 | 503 | 520 |
| Four Ball Wear, ASTM D2266 at 40 kg, 1200 rpm for 1 hr. | 0.49 | 0.40 |
| Four Ball EP, ASTM D2596 | | |
| last nonseizure load, kg | 63 | 40 |
| weld load, kg | 315 | 315 |
| load wear index | 38.1 | 41.9 |
| Optimol SRV Stepload Test, 80° C. Maximum Passing Load, Newtons | 900 | 900 |
| Optimol SRV Wear Test, 200 N, 1 hr, 80° C., | | |
| scar depth, micro-inches | 40 | 17 |
| scar width, inches | 0.014 | 0.018 |
| U.S. Steel Grease Mobility Test, S-75, at −20° F., grams/minute | | |
| 50 PSI | 0.20 | — |
| 100 PSI | 1.36 | — |
| 150 PSI | 2.63 | — |

Results were very good. Optimol SRV stepload and wear test results in particular indicate the superior extreme pressure antiwear performance of the two test greases. The Optimol SRV stepload test is the procedure recommended by Optimol Lubricants, Inc. and used by Automotive Manufacturers such as General Motors for lubricant evaluation. This method was also specified by the U.S. Air Force Laboratories Test Procedure of Mar. 6, 1985. In the test, a 10 mm steel ball is oscillated under load increments of 100 newtons on a lapped steel disc lubricated with the grease being tested until seizure occurs.

The Optimol SRV wear test is a similar procedure in which the load is maintained at the specified level for the specified time and temperature conditions. At the conclusion of the time interval the bottom disk is cleaned with heptane and the wear scar is measured using a profilometer. Both scar depth and width measurements are recorded as an indication of the wear that occurred during the test.

It can be seen that both greases are of softer consistencies generally desired for use as railroad track/wheel flange greases. The grease of Example 33 is nearly an NLGI 00 grade; the grease of Example 34 is an NLGI 0 grade. Both greases exhibited distinct adherence properties in that when a layer or film of either grease was applied to a flat, steel surface, the grease could not be entirely removed by manual wiping, regardless of the force used or the number of repetitions. The only way that either of the greases could be removed from the flat, steel surface was to wash it off using heptane solvent. The grease of Example 34 appeared to be the most adherent, in keeping with its higher level of Shellvis 40 polymer.

EXAMPLES 35-36

Another polyurea base grease was prepared in a manner similar to that of Example 1, except that a paraffinic, solvent-extracted base oil having a viscosity of 150 SUS at 100° F. was used instead of the 350 SUS oil. Two rail track/wheel flange greases were prepared from portions of that polyurea base grease using a procedure similar to that of Examples 33-34. The two greases had the following compositions:

| Test Grease Component, % (wt) | Ex. 35 | Ex. 36 |
|---|---|---|
| 850 SUS Oil | 54.73 | 54.06 |
| 150 SUS Oil | 27.57 | 27.24 |
| Polyurea Thickener | 5.00 | 5.00 |
| Tricalcium Phosphate | 5.00 | 5.00 |
| Calcium Carbonate | 5.00 | 5.00 |
| Shellvis 40 | 2.00 | 3.00 |
| Lubrizol 5391 | 0.50 | 0.50 |
| Vanlube 848 | 0.20 | 0.20 |

The grease was tested and had the following performance properties:

| | | |
|---|---|---|
| Worked Penetration, ASTM D217 | 441 | 431 |
| Dropping Point, °F., ASTM D2265 | 471 | 480 |
| Four Ball Wear, ASTM D2266 at 40 kg, 1200 rpm for 1 hr | 0.45 | 0.45 |
| Four Ball EP, ASTM D2596 | | |
| last nonseizure load, kg | 63 | 63 |
| weld load, kg | 620 | 400 |
| load wear index | 59.6 | 46.7 |
| Optimol SRV Stepload Test, 80° C. Maximum Passing Load, Newtons | 1,000 | 900 |
| Optimol SRV Stepload Test, 150° C. Maximum Passing Load, Newtons | 900 | 900 |
| Optimol SRV Wear Test, 200 N, 1 hr, 80° C., | | |
| scar depth, micro-inches | 25 | 22 |
| scar width, inches | 0.016 | 0.016 |
| U.S. Steel Grease Mobility Test, S-75, at −20° F., grams/minute | | |
| 50 PSI | 1.05 | 0.25 |
| 100 PSI | 3.42 | 1.15 |
| 150 PSI | 5.62 | 2.02 |
| Copper Strip Corrosion, ASTM D4048, 300° F., 24 hr. | 1A | 1A |

As can be seen, results were excellent. The higher level of tricalcium phosphate and calcium carbonate produced generally higher levels of extreme pressure antiwear performance when compared to the greases of Examples 33-34. The Optimol SRV stepload test results at 150° C. indicate that the extreme pressure antiwear performance is maintained at greatly elevated temperatures. The Copper Strip Corrosion test result indicates that despite the excellent extreme pressure antiwear performance, the grease is not chemically corrosive at high temperatures. As with the greases of Examples 33-34, both greases appeared quite adherent when applied to metal surfaces, with the grease of Example 36 being the more adherent of the two. The greater adherence of the Example 36 grease an also be seen by its reduced mobility, compared with the Example 35 grease. However, the grease of Example 36 had similar mobility to the grease of Example 33.

EXAMPLE 37

A railroad track/wheel flange grease was prepared in a manner similar to that of Examples 35-36, except that the final milling was done using a Gaulin Homogenizer at 5,000 psi. The grease also contained blue dye for cosmetic purposes. The grease had the following composition:

| Component | % (wt) |
|---|---|
| 850 SUS Oil | 53.81 |
| 150 SUS Oil | 27.11 |
| Polyurea Thickener | 6.00 |
| Tricalcium Phosphate | 5.14 |
| Calcium Carbonate | 5.14 |
| Shellvis 40 | 2.06 |
| Lubrizol 5391 | 0.50 |
| Vanlube 848 | 0.20 |
| Blue Dye | 0.04 |

The grease was tested and had the following performance properties:

| | |
|---|---|
| Worked Penetration, ASTM D217 | 396 |
| Dropping Point, °F., ASTM D2265 | 463 |
| Oil Separations, SDM 433, % | |
| 24 hr, 212° F. | 0.5 |
| 24 hr, 300° F. | 2.6 |
| 24 hr, 350° F. | 26.5 |
| Four Ball Wear, ASTM D2266 at 40 kg, 1200 rpm for 1 hr | 0.45 |
| Four Ball EP, ASTM D2596 | |
| last nonseizure load, kg | 80 |
| weld load, kg | 400 |
| load wear index | 50.6 |
| Optimol SRV Stepload Test, 80° C. Maximum Passing Load, Newtons | 900 |
| Optimol SRV Stepload Test, 150° C. Maximum Passing Load, Newtons | 900 |

Test results were good. Oil separation was measured by the oil separation cone test (bleed test), SDM 433 standard test of the Saginaw Steering Gear Division of General Motors. In the test, the grease was placed on a 60 mesh nickel screen cone. The cone was heated in an oven for the indicated time at the listed temperature. The percentage decrease in the weight of the grease was measured. Oil separation is very good for 212° F. and 300° F., but increased dramatically at 350° F. The extremely adherent texture demonstrated in Examples 33–36 was present in this grease as well. The consistency of the grease was between NLGI grades 0 and 00.

EXAMPLE 38

Another railroad track/wheel flange grease was prepared in a manner similar to that of Example 37. The grease had the following composition:

| Component | % (wt) |
|---|---|
| 850 SUS Oil | 53.45 |
| 150 SUS Oil | 26.93 |
| Polyurea Thickener | 6.88 |
| Tricalcium Phosphate | 5.00 |
| Calcium Carbonate | 5.00 |
| Shellvis 40 | 2.00 |
| Lubrizol 5391 | 0.50 |
| Vanlube 848 | 0.20 |
| Blue Dye | 0.04 |

The grease was tested and had the following performance properties:

| | |
|---|---|
| Worked Penetration, ASTM D217 | 378 |
| Dropping Point, °F., ASTM D2265 | 497 |
| Oil Separations, SDM 433, % | |
| 24 hr, 212° F. | 0.5 |

-continued

| | |
|---|---|
| 24 hr, 300° F. | 0.3 |
| 24 hr, 350° F. | 5.5 |
| Four Ball Wear, ASTM D2266 at 40 kg, 1200 rpm for 1 hr | 0.44 |
| Four Ball EP, ASTM D2596 | |
| last nonseizure load, kg | 63 |
| weld load, kg | 620 |
| load wear index | 60.6 |
| Optimol SRV Stepload Test, 80° C. Maximum Passing Load, Newtons | 800 |
| Optimol SRV Stepload Test, 150° C. Maximum Passing Load, Newtons | 900 |
| U.S. Steel Grease Mobility Test, S-75, at −20° F., grams/minute | |
| 50 PSI | 0.80 |
| 100 PSI | 1.91 |
| 150 PSI | 2.54 |

The resulting grease had a consistency of NLGI grade 0. Oil separation at 350° F. was greatly improved over that of Example 37.

EXAMPLE 39

Another railroad track/wheel flange grease was prepared in a manner similar to Example 38 except that the final milling was done at 7,000 psi using a Gaulin Homogenizer. The grease had the following composition:

| Component | % (wt) |
|---|---|
| 850 SUS Oil | 56.03 |
| 150 SUS Oil | 28.23 |
| Polyurea Thickener | 3.00 |
| Tricalcium Phosphate | 5.00 |
| Calcium Carbonate | 5.00 |
| Shellvis 40 | 2.00 |
| Lubrizol 5391 | 0.50 |
| Vanlube 848 | 0.20 |
| Blue Dye | 0.04 |

The grease was tested and had the following performance properties:

| | |
|---|---|
| Worked Penetration, ASTM D217 | 449 |
| Dropping Point, °F., ASTM D2265 | 458 |
| Four Ball Wear, ASTM D2266 at 40 kg, 1200 rpm for 1 hr | 0.49 |
| Four Ball EP, ASTM D2596 | |
| last nonseizure load, kg | 63 |
| weld load, kg | 400 |
| load wear index | 50.0 |
| Optimol SRV Stepload Test, 80° C. Maximum Passing Load, Newtons | 900 |
| Optimol SRV Stepload Test, 150° C. Maximum Passing Load, Newtons | 800 |
| U.S. Steel Grease Mobility Test, S-75, at −20° F., grams/minute | |
| 50 PSI | 1.10 |
| 100 PSI | 3.82 |
| 150 PSI | 6.17 |

The resulting grease was essentially an NLGI grade 000 in consistency. Despite its very soft consistency, the texture was quite adherent. Like earlier examples, when the grease was applied as a layer or film to a flat, steel surface, the only method which could completely remove it was to use a solvent such as heptane.

EXAMPLES 40–42

A polyurea base grease was prepared in a manner similar to Example 1, except that a paraffinic, solvent-extracted base oil with a viscosity of 150 SUS at 100° F. was used instead of the paraffinic, solvent extracted 350 SUS oil. This base grease was stirred and heated to 300° F. and Shellvis 40 was added. The grease was allowed to mix while cooling to 250° F. Then the grease was cyclically milled with a rotating knife mill to insure complete dispersion of the Shellvis 40 polymer in the base grease. The final composition of the polymer-additized polyurea base grease was:

| Component | % (wt) |
|---|---|
| 850 SUS Oil | 64.59 |
| 150 SUS Oil | 16.66 |
| Polyurea Thickener | 15.00 |
| Shellvis 40 | 3.75 |

Three portions of the polymer-additized polyurea base grease were separately finished in a grease kettle by addition of Nasul BSN, Vanlube 848, and graphite. Each of the three finished greases contained a different type of graphite. The three graphites used were: Superior Graphite No. 9039, a synthetic graphite (graphitic carbon) with a mean particle size of about 3.5 microns and comprising about 90% graphite structure; Superior Graphite No. 4939, a high temperature purified natural graphite with a mean particle size of about 3.5 microns and comprising nearly 100% graphite structure; Superior Graphite No. 3226, an "amorphous graphite" comprising about 75% carbon by weight with the remaining material comprising oxides of iron, aluminum, and silicon. The Superior Graphite No. 3226 comprised virtually no extended graphite structure. All three graphites are available from Superior Graphite Company. The three greases had the following compositions:

| Test Grease Component, % (wt) | Ex. 40 | Ex.41 | Ex. 42 |
|---|---|---|---|
| 850 SUS Oil | 53.23 | 53.23 | 53.23 |
| 150 SUS Oil | 26.82 | 26.82 | 26.82 |
| Polyurea Thickener | 7.00 | 7.00 | 7.00 |
| Superior Graphite No. 9030 | 10.00 | — | — |
| Superior Graphite No. 3226 | — | 10.00 | — |
| Superior Graphite No. 4939 | — | — | 10.00 |
| Shellvis 40 | 1.75 | 1.75 | 1.75 |
| Nasul BSN | 1.00 | 1.00 | 1.00 |
| Vanlube 848 | 0.20 | 0.20 | 0.20 |

The greases were tested and had the following performance properties:

| | | | |
|---|---|---|---|
| Worked Penetration, ASTM D217 | 364 | 376 | 382 |
| Dropping Point, °F., ASTM D2265 | 500+ | 509 | 508 |
| Four Ball Wear, ASTM D2266 at 40 kg, 1200 rpm for 1 hr. | 0.66 | 0.63 | 0.61 |
| Four Ball EP, ASTM D2596 | | | |
| last nonseizure load, kg | 40 | 40 | 32 |
| weld load, kg | 250 | 160 | 200 |
| load wear index | 32.4 | 29.6 | 27.8 |
| Optimol SRV Stepload Test, 80° C. Maximum Passing Load, Newtons | 200 | 400 | — |
| Optimol SRV Stepload Test, 150° C. Maximum Passing Load, Newtons | — | 400 | — |
| Optimol SRV Wear Test, 200 N, 1 hr., 80° C., | | | |
| scar depth, micro-inches | 200 | 252 | 146 |
| scar width, inches | 0.026 | 0.028 | 0.026 |
| U.S. Steel Grease Mobility Test, S-75, at −20° F., grams/minute | | | |
| 50 PSI | 0.23 | — | — |
| 100 PSI | 0.85 | — | — |
| 150 PSI | 1.37 | — | — |
| Copper Strip Corrosion, ASTM D4048, 300° F., 24 hr. | 2C | 2C | 2C |

Although all three greases exhibited an adhesive texture, the overall test results on all three greases were poor. Extreme pressure antiwear performance of all three graphite greases was generally inferior to the greases of Examples 33–39. Optimol SRV stepload and wear test data was particularly poor, with the amorphous graphite grease of Example 41 being the worst. This is undoubtedly due to the high level of abrasive oxides of iron, aluminum, and silicon present in that graphite. The least abrasive graphite grease was Example 42, containing the purified natural graphite. However, even that grease gave far more SRV wear depth than the novel railroad track/wheel flange greases of Examples 33–36. Also, all three graphite greases were highly corrosive at 300° F. as evidenced by the Copper Strip test results. The reason for this is not clear, but may be due to corrosive impurities adsorbed on the surface of graphites.

EXAMPLE 43

A sample of a stable graphite dispersion in mineral oil sold under the name of Rail Lube No. 32 by Superior Graphite was evaluated. Rail Lube No. 32 is a high graphite content material marketed as a railroad track/-wheel flange lubricant. The sample of Rail Lube No. 32 was tested and had the following performance properties.

| | |
|---|---|
| Four Ball Wear, ASTM D2266 at 40 kg, 1200 rpm for 1 hr | 1.00 |
| Four Ball EP, ASTM D2596 | |
| last nonseizure load, kg | 50 |
| weld load, kg | 500 |
| load wear index | 87.1 |
| Optimol SRV Stepload Test, 80° C. Maximum Passing Load, Newtons | 300 |
| Optimol SRV Stepload Test, 150° C. Maximum Passing Load, Newtons | 300 |
| Optimol SRV Wear Test, 200 N, 1 hr, 80° C., | |
| scar depth, micro-inches | 420 |
| scar width, inches | 0.040 |
| Copper Strip Corrosion, ASTM D4048, 300° F., 24 hr. | 4A |

Although the Rail Lube No. 32 gave good Four Ball EP test results, it gave extremely bad results on all other extreme pressure antiwear tests. The Four Ball Wear and Optimol SRV Wear results were particularly bad, indicating the highly abrasive nature of this high graphite dispersion. As with the previous three graphite greases, this graphite dispersion was also very corrosive as indicated by the 300° F. Copper Strip Corrosion Test.

EXAMPLE 44

A lithium 12-hydroxystearate thickened rail track/-wheel flange grease using molybdenum disulfide was made as follows. A 27.91 pound portion of 850 SUS oil was added to a grease kettle. The oil was heated using a hot heat transfer oil recirculating through the kettle jacket. While heating and stirring, 3,261.92 grams of methyl 12-hydroxystearate were added. The mixture was stirred at 177° F. until all the ester had melted and mixed with the oil. Then 503.24 grams of lithium hydroxide monohydrate and 300 ml of water were added and the grease kettle was sealed shut. The kettle was then heated until the internal temperature was 220° F. The contents were stirred for one hour at that temperature under sealed conditions. The contents were then further heated to 340° F. while continuing to stir under sealed conditions. When the internal pressure of the kettle reached 105 psi, the kettle was vented through a port located at the top of the kettle lid. When the internal pressure had been completely bled off, the kettle was opened to reveal a heavy, dry base grease. To the base grease was added 1,589 grams of Shellvis 40 and 105.93 grams of Vanlube 848. The grease was then stirred and heated to 410° F. while slowly adding 3,602 grams of 850 SUS oil. An additional 3.5 pounds of 850 SUS oil and 19.82 pounds of 150 SUS oil were slowly added. When 410° F. was reached, the melted grease was cyclically milled using a rotating knife blade mill while slowly cooling. The cyclic milling was stopped when the grease temperature cooled to 376° F. When the grease was cooled to 250° F., a portion was removed and stored for other use. The remainder was finished with Lubrizol 5391, molybdenum disulfide and additional 850 SUS oil and 150 SUS oil. The finished grease was milled with a rotor-stator mill using a gap setting of 0.005 inches. The final grease had the following composition:

| Component | % (wt) |
|---|---|
| 850 SUS Oil | 59.34 |
| 150 SUS Oil | 29.90 |
| Lithium 12-hydroxystearate | 5.00 |
| Excess Lithium hydroxide | 0.06 |
| Shellvis 40 | 2.50 |
| Molybdenum disulfide | 2.50 |
| Lubrizol 5391 | 0.50 |
| Vanlube 848 | 0.20 |

The grease was tested and had the following performance properties:

| | |
|---|---|
| Worked Penetration, ASTM D217 | 318 |
| Dropping Point, °F., ASTM D2265 | 414 |
| Oil Separations, SDM 433, % | |
| 24 hr, 212° F. | 0.4 |
| 24 hr, 300° F. | 5.0 |
| 24 hr, 350° F. | 20.6 |
| Four Ball Wear, ASTM D2266 at 40 kg, 1200 rpm for 1 hr | 0.48 |
| Four Ball EP, ASTM D2596 | |
| last nonseizure load, kg | 63 |
| weld load, kg | 250 |
| load wear index | 32.0 |
| Optimol SRV Stepload Test, 80° C. Maximum Passing Load, Newtons | 300 |
| U.S. Steel Grease Mobility Test, S-75, at −20° F., grams/minute | |
| 50 PSI | 1.05 |
| 100 PSI | 4.81 |
| 150 PSI | 7.64 |
| Copper Strip Corrosion, ASTM D4048, 300° F., 24 hr. | 4A |

The grease of Example 44 generally gave better extreme pressure antiwear performance than the preceding graphite-containing compositions. However, it was not as good as the extreme pressure antiwear performance of the railroad track/wheel flange greases of Examples 33–39. Like the preceding graphite-containing compositions, the molybdenum disulfide grease of Example 44 showed corrosive properties as indicated by the 300° F. Copper Strip Corrosion Test. This is attributable to the inorganic sulfur present in molybdenum disulfide.

EXAMPLE 45

A sample of another commercially available rail track/wheel flange grease sold by Mobil Oil Company under the brand name of Mobil Curve Grease 213 was obtained and evaluated. Mobil Rail Curve Grease 213 is a lithium 12-hydroxystearate thickened grease containing 3% (wt) molybdenum disulfide. The consistency of this product is NLGI grade 1. An NLGI grade 000 product essentially equivalent to this product (except for consistency) is also available from Mobil under the brand name of Mobil Curve Grease 213-000. The sample of Mobil Curve Grease 213 was tested and had the following performance properties:

| | |
|---|---|
| Worked Penetration, ASTM D217 | 317 |
| Dropping Point, °F., ASTM D2265 | 363 |
| Oil Separations, SDM 433, % | |
| 24 hr, 212° F. | 2.2 |
| 24 hr, 300° F. | 7.0 |
| 24 hr, 350° F. | 17.3 |
| Four Ball Wear, ASTM D2266 at 40 kg, 1200 rpm for 1 hr | 0.50 |
| Four Ball EP, ASTM D2596 | |
| last nonseizure load, kg | 63 |
| weld load, kg | 250 |
| load wear index | 32.6 |
| Optimol SRV Stepload Test, 80° C. Maximum Passing Load, Newtons | 300 |
| Optimol SRV Stepload Test, 150° C. Maximum Passing Load, Newtons | 200 |
| Optimol SRV Wear Test, 200 N, 1 hr, 80° C., | |
| scar depth, micro-inches | 120 |
| scar width, inches | 0.020 |
| U.S. Steel Grease Mobility Test, S-75, at −20° F., grams/minute | |
| 50 PSI | 0.92 |
| 100 PSI | 3.35 |
| 150 PSI | 4.97 |
| Copper Strip Corrosion, ASTM D4048, 300° F., 24 hr. | 4B |

Test results for the Mobil Curve Grease 213 are generally similar to those of Example 44. Optimol SRV Wear Test results are significantly inferior to the rail track/wheel flange greases of Examples 33–36.

EXAMPLE 46

The rail track/wheel flange grease of Example 39 was evaluated by a major eastern U.S. railroad. Eight other lubricants were also evaluated including: three lubricants comprising graphite; three lubricants comprising molybdenum disulfide; one lubricant comprising an oil-soluble extreme pressure antiwear additive package; one lubricant having no extreme pressure antiwear additive. Among those eight lubricants were the graphite dispersion of Example 43 and the molybdenum disulfide lubricant Mobil Curve Grease 213-000 mentioned in Example 45.

The evaluation was done at a special test track facility in Pueblo, Colo. using a train consisting of a locomotive, twenty-four loaded 100 ton hopper cars, and a special instrumentation car. The instrumentation car was designed specifically to measure the work done by the locomotive to pull the train around the test track. This parameter was used to compare the effectiveness of rail track/wheel flange lubricants to reduce friction at the rail/flange interface thereby increasing fuel economy. The grease of Example 39 performed well, providing work reductions equal to or exceeding all other greases tested. Also, the grease of Example 39 was the only extreme pressure antiwear lubricant tested which did not contain components corrosive at high temperatures such as 300° F. or higher.

Further work done by the railroad company indicated that all the graphite-containing lubricants promoted abrasive wear to on-board lubricator equipment. The rail track/wheel flange lubricant grease of Example 39 used a food grade extreme pressure antiwear additive package.

EXAMPLE 47

Although graphite-containing lubricants can be abrasive and of inferior antiwear performance, the performance of such lubricants can be significantly improved by incorporating the novel technology illustrated by Examples 33–39. A lubricating grease was made by a procedure similar to that of the polyurea-thickened graphite grease of Example 40, except that tricalcium phosphate and calcium carbonate were also added. The grease had the following composition:

| Component | % (wt) |
|---|---|
| 850 SUS Oil | 52.27 |
| 150 SUS Oil | 26.33 |
| Superior Graphite No. 9039 | 10.00 |
| Polyurea Thickener | 5.00 |
| Tricalcium Phosphate | 2.00 |
| Calcium Carbonate | 2.00 |
| Shellvis 40 | 2.00 |
| Lubrizol 5391 | 0.20 |
| Vanlube 848 | 0.20 |

The grease was tested and had the following performance properties:

| | |
|---|---|
| Worked Penetration, ASTM D217 | 441 |
| Dropping Point, °F., ASTM D2265 | 473 |
| Four Ball Wear, ASTM D2266 at 40 kg, 1200 rpm for 1 hr | 0.50 |
| Four Ball EP, ASTM D2596 | |
| last nonseizure load, kg | 50 |
| weld load, kg | 400 |
| load wear index | 46.7 |
| Optimol SRV Stepload Test, 80° C. Maximum Passing Load, Newtons | 400 |
| Optimol SRV Stepload Test, 150° C. Maximum Passing Load, Newtons | 600 |
| Optimol SRV Wear Test, 200 N, 1 hr, 80° C., | |
| scar depth, micro-inches | 50 |
| scar width, inches | 0.016 |
| U.S. Steel Grease Mobility Test, S-75, at −20° F., grams/minute | |
| 50 PSI | 0.65 |
| 100 PSI | 2.42 |
| 150 PSI | 3.66 |

Both this grease and the grease of Example 40 exhibited significant adhesive texture. However, significant differences between this grease and the Example 40 grease exist. By comparing the results of this grease with that of Example 40, one can see that the extreme pressure antiwear properties have significantly improved by incorporating the tricalcium phosphate and calcium carbonate into the graphite grease. The Optimol SRV Wear improvement is especially surprising since the poor SRV Wear performance of the Example 40 grease was most likely due to abrasive contaminants. Abrasive wear cannot generally be reduced by complementary inclusion of other extreme pressure antiwear additives. Therefore, the improved overall extreme pressure antiwear performance of the grease of Example 47 is a surprising and unexpected benefit of the novel technology described herein.

EXAMPLE 48

The grease of Example 39 contained only 3% (wt) of polyurea thickener, a level far below thickener levels typical of polyurea-thickened lubricating greases. Even so, the resulting Example 39 grease retained a stable grease structure. This suggests that it may be possible to reduce the polyurea thickener even further or even eliminate it while still retaining a stable grease structure. To investigate that possibility the following composition was made. To a grease kettle was added 24.8 pounds of 850 SUS oil, 12.5 pounds of 150 SUS oil, 5.0 pounds of tricalcium phosphate, 5.0 pounds of calcium carbonate, 90.8 grams of Vanlube 848, 908.0 grams of Shellvis 40, and 9.08 grams of blue dye. The mixture was stirred and heated to 300° F. by circulating hot heat exchange fluid through the kettle jacket. At 300° F. the mixture was cyclically milled using a rotating knife blade mill. The mixture took on a distinctly adhesive grease-like texture. The grease was cooled to 200° F. and 227.0 grams of Lubrizol 5391 was mixed into the grease. The grease was cooled to 152° F. and then milled out into a storage container, using the rotating knife blade mill. The resulting composition had a very adhesive grease texture which was stable. No visible separation of components occurred even after one year of room temperature storage. The grease had the following composition:

| Component | % (wt) |
|---|---|
| 850 SUS Oil | 49.58 |
| 150 SUS Oil | 24.98 |
| Tricalcium Phosphate | 10.00 |
| Calcium Carbonate | 10.00 |
| Shellvis 40 | 4.00 |
| Lubrizol 5391 | 1.00 |
| Vanlube 848 | 0.40 |
| Blue Dye | 0.04 |

The grease was tested and had the following performance properties:

| | |
|---|---|
| Worked Penetration, ASTM D217 | |
| Worked 60 strokes | 400 |
| Worked 10,000 strokes | 406 |
| Worked 100,000 strokes | 411 |
| Dropping Point, °F., ASTM D2265 | 302 |

-continued

| | |
|---|---|
| Four Ball Wear, ASTM D2266 at 40 kg, 1200 rpm for 1 hr | 0.68 |
| Four Ball EP, ASTM D2596 | |
| last nonseizure load, kg | 63 |
| weld load, kg | 800 |
| load wear index | 89.7 |
| Optimol SRV Stepload Test, 80° C. Maximum Passing Load, Newtons | 700 |
| Optimol SRV Stepload Test, 150° C. Maximum Passing Load, Newtons | 700 |

The grease was extremely adhesive. Removal from a flat, steel surface was accomplished only with repeated application of a solvent such as heptane. The grease had excellent shear stability as indicated by the very small change in penetration upon 100,000 strokes of working. Even after such shearing, the extreme adhesive texture remained unaltered. Extreme pressure antiwear properties were generally good although the Four Ball Wear was higher than the greases of Examples 33–39.

EXAMPLES 49–50

Two compositions were made by adding 850 SUS oil and Shelvis 40 to a grease kettle, and then heating, mixing, and milling in a manner similar to that of Example 48. Final compositions are given below:

| Test Lubricant Component, % (wt) | Ex. 49 | Ex. 50 |
|---|---|---|
| 850 SUS Oil | 96.00 | 94.00 |
| Shellvis 40 | 4.00 | 6.00 |

Both products were viscous mineral oil solutions of the polymeric additive but did not have any grease structure.

EXAMPLE 51

A lubricant composition was made by adding 850 SUS oil, tricalcium phosphate, and calcium carbonate to a grease kettle, and then heating, mixing, and milling in a manner similar to that of Example 48. Final compositions are given below:

| Component | % (wt) |
|---|---|
| 850 SUS Oil | 80.00 |
| Tricalcium Phosphate | 10.00 |
| Calcium Carbonate | 10.00 |

The composition was, as expected, unstable. As soon as the mixture was milled out into a five gallon container, the solid tricalcium phosphate and calcium carbonate quickly and completely settled out. No grease structure could be obtained. The results of Examples 48–51 show that the polymeric additive, tricalcium phosphate, and calcium carbonate interact to form a grease structure, even when conventional grease thickeners such as polyurea, or metal fatty acid salts are not present. Furthermore, Examples 49–51 show that this interaction could not have been anticipated from the properties of either the polymer or the tricalcium phosphate and calcium carbonate alone.

EXAMPLE 52

Another composition was made in a manner similar to Example 51. Calcium sulfate and calcium hydroxide were used instead of tricalcium phosphate and a blend of 850 SUS oil and 150 SUS oil was used instead of 850 SUS oil alone. The oil soluble additives Vanlube 848 and Lubrizol 5391 were also used. The final blend composition was as follows:

| Component | % (wt) |
|---|---|
| 850 SUS Oil | 50.00 |
| 150 SUS Oil | 25.52 |
| Calcium Sulfate | 10.42 |
| Calcium Carbonate | 10.42 |
| Calcium Hydroxide | 2.08 |
| Lubrizol 5391 | 1.04 |
| Vanlube 848 | 0.52 |

Just as with the composition of Example 51, this composition did not exhibit any grease structure. The solid calcium sulfate, calcium carbonate, and calcium hydroxide quickly and completely settled out of the oil.

EXAMPLES 53–55

Three lubricating greases were made in a manner similar to Example 52, except that they also comprised the polymeric additive Shellvis 40. The three greases had the following compositions:

| Test Grease Component, % (wt) | Ex. 53 | Ex. 54 | Ex. 55 |
|---|---|---|---|
| 850 SUS Oil | 48.00 | 40.71 | 39.39 |
| 150 SUS Oil | 24.50 | 20.79 | 20.11 |
| Calcium Sulfate | 10.00 | 15.00 | 15.00 |
| Calcium Carbonate | 10.00 | 15.00 | 15.00 |
| Calcium Hydroxide | 2.00 | 3.00 | 3.00 |
| Shellvis 40 | 4.00 | 4.00 | 6.00 |
| Lubrizol 5391 | 1.00 | 1.00 | 1.00 |
| Vanlube 848 | 0.50 | 0.50 | 0.50 |

The greases were tested and had the following performance properties:

| | | | |
|---|---|---|---|
| Worked Penetration, ASTM D217 | — | — | 344 |
| Dropping Point, °F., ASTM D2265 | — | — | 350 |
| Four Ball Wear, ASTM D2266 at 40 kg, 1200 rpm for 1 hr | — | — | 0.55 |
| Four Ball EP, ASTM D2596 | | | |
| last nonseizure load, kg | — | — | 50 |
| weld load, kg | — | — | 500 |
| load wear index | — | — | 65.1 |
| Optimol SRV Stepload Test, 80° C. Maximum Passing Load, Newtons | 800 | 700 | 600 |
| Optimol SRV Stepload Test, 150° C. Maximum Passing Load, Newtons | — | 800 | 600 |

All three compositions were stable greases having an extremely adhesive texture.

EXAMPLE 56

A lubricating grease was made in a manner similar to that to Examples 53–55, except that lower levels of the calcium sulfate, calcium carbonate, calcium hydroxide, and Shellvis 40 were used. Also, an additional ethylene-propylene copolymer Functional V-188, available from Functional Products, Inc. was used. The grease had the following composition:

| Component | % (wt) |
|---|---|
| 850 SUS Oil | 50.87 |
| 150 SUS Oil | 25.63 |
| Calcium Sulfate | 8.00 |
| Calcium Carbonate | 8.00 |

-continued

| Component | % (wt) |
|---|---|
| Calcium Hydroxide | 1.50 |
| Shellvis 40 | 2.00 |
| Functional V-188 | 2.50 |
| Lubrizol 5391 | 1.00 |
| Vanlube 848 | 0.50 |

The grease was tested and had the following performance properties:

| | |
|---|---|
| Worked Penetration, ASTM D217 | 605 |
| Four Ball Wear, ASTM D2266 at 40 kg, 1200 rpm for 1 hr | 0.42 |
| Four Ball EP, ASTM D2596 | |
| last nonseizure load, kg | 80 |
| weld load, kg | 800+ |
| load wear index | 100+ |
| Copper Strip Corrosion, ASTM D4048, 300° F., 24 hr | 1A |

The resulting composition was a very soft, semi-fluid grease with an adhesive and somewhat stringy texture. Upon standing at room temperature for five months, syneresis had occurred. Simple stirring with a steel spatula restored the original appearance and texture.

EXAMPLES 57-61

Five portions of the grease of Example 48 were augmented with varying amounts of several oil soluble antiwear additives. The additives used were: Durad 150, a triaryl phosphate available from FMC Corporation; Amoco 198, a zinc dialkyldithiophosphate available from Amoco Petroleum Additives Company; Lubrizol 6063A, a sulfur-phosphorus industrial gear oil additive package; Vanlube 7723, a 4,4'-methylene bis(-dibutyldithiocarbamate) additive available from R. T. Vanderbilt Company, Inc. The five greases had the following compositions:

| Text Grease Component, % (wt) | Ex. 57 | Ex. 58 | Ex. 59 | Ex 60 | Ex 61 |
|---|---|---|---|---|---|
| Example 48 Grease | 98.50 | 99.50 | 96.00 | 94.00 | 96.00 |
| Durad 150 | 1.50 | — | — | 3.00 | — |
| Amoco 198 | — | 0.50 | — | — | — |
| Vanlube 7723 | — | — | 4.00 | 3.00 | — |
| Lubrizol 6063A | — | — | — | — | 4.00 |
| The greases were tested and had the following performance properties: | | | | | |
| Four Ball Wear, ASTM D2266 at 40 kg, 1200 rpm for 1 hr. | 0.63 | 0.53 | 0.72 | 0.48 | 0.46 |

The greases were tested and had the following performance properties:

By comparing the above Four Ball Wear test results with those of Example 48, one can see the level of improvement afforded by the additives. Durad 150 gave little improvement; Vanlube 7723 gave none. Their combined use gave significant improvement. Amoco 198 gave only modest improvement in antiwear performance. Lubrizol 6063A gave good improvement. The use of sulfur-containing organic additives such as Vanlube 7723, Amoco 198, or Lubrizol 6063A will result in increased corrosivity at high temperatures. However, for applications where such properties are not important, then compositions such as those in Examples 57-61 can be used.

EXAMPLES 62-63

A polyurea base grease is made in a manner similar to Example 1, except that all the base oil used was 850 SUS oil. The final composition was as follows:

| Component | % (wt) |
|---|---|
| 850 SUS Oil | 78.00 |
| Polyurea | 22.00 |

Two lubricating greases were made in a manner similar to Examples 53-55, except that very minor amounts of polyurea were also incorporated into the greases. The 22% (wt) polyurea base grease in 850 SUS oil was used as the source of polyurea. Also, a paraffinic, solvent-extracted 350 SUS base oil similar to that used in Example 1 was used instead of 850 SUS oil. The two greases had the following compositions:

| Test Grease Component, % (wt) | Ex. 62 | Ex. 63 |
|---|---|---|
| 350 SUS Oil | 69.64 | 63.37 |
| 850 SUS Oil | 2.36 | 3.53 |
| Calcium Sulfate | 10.00 | 12.00 |
| Calcium Carbonate | 10.00 | 12.00 |
| Calcium Hydroxide | 2.00 | 2.40 |
| Shellvis 40 | 4.00 | 4.00 |
| Polyurea | 0.67 | 1.00 |
| Lubrizol 5391 | 1.00 | 1.20 |
| Vanlube 848 | 0.33 | 0.50 |
| The grease was tested and had the following performance properties: | | |
| Worked Penetration, ASTM D217 | | |
| Worked 60 strokes | 322 | 328 |
| Worked 100,000 strokes | 323 | 327 |
| Oil Separations, SDM 433, % | | |
| 24 hr, 212° F. | 0 | 0 |
| 24 hr, 300° F. | 0.1 | 0 |
| 24 hr, 350° F. | 0.5 | 3.2 |
| Dropping Point, °F., ASTM D2265 | 403 | 397 |
| Four Ball Wear, ASTM D2266 at 40 kg, 1200 rpm for 1 hr | 0.40 | 0.60 |
| Four Ball EP, ASTM D2596 | | |
| last nonseizure load, kg | 80 | 80 |
| weld load, kg | 800+ | 620 |
| load wear index | 110+ | 80.0 |
| Optimol SRV Stepload Test, 80° C. Maximum Passing Load, Newtons | 1,000 | 900 |

By comparing the results of these two greases with previous Examples, one can see that even very small levels of polyurea are enough to raise the dropping point and improve high temperature oil separation significantly. As with earlier greases, the two greases of Examples 62-63 had an extremely adhesive texture.

EXAMPLES 64-67

The dropping point of greases similar to those of Example 48 and Examples 53-56 can also be increased by addition of very minor levels of materials such as clays and fumed silica, or other similar materials. Several portions of the grease of Example 55 were augmented with amounts of the following materials: Bentone 34, a bentonite clay material available from N. L. Industries; Cab-O-Sil, a fumed silica available from Cabot Corporation having a 0.2 micron mean aggregate length. Although silica (silicon dioxide) is usually quite abrasive and should be avoided in high performance lubricants, fumed silica of this type can be satisfactorily used. The reason for this is the extremely small particle size of the fumed silica in the final grease and nature of the surface of those particles. The Bentone 34 and Cab-O-Sil were added to the Example 55 grease, stirred with a steel spatula and heated to about 300° F. The greases were then milled with a three-roll mill to achieve a homogeneous grease. Four such greases were prepared and had the following compositions:

| Test Grease Component, % (wt) | Ex. 64 | Ex. 65 | Ex. 66 | Ex. 67 |
|---|---|---|---|---|
| Example 55 Grease | 97.00 | 97.00 | 99.00 | 99.00 |
| Bentone 34 | 3.00 | — | 1.00 | — |
| Cab-O-Sil | — | 3.00 | — | 1.00 |
| The greases were tested and had the following dropping points: | | | | |
| Dropping Point, °F. ASTM D2265 | 532 | 560+ | 393 | 386 |

All of the above four greases had dropping points which had been significantly increased compared to that of the Example 55 grease.

EXAMPLE 68

To a portion of the grease of Example 62 was added a polyalkylene polymer having a molecular weight greater than 20,000,000, sold under the brand name of CDR-102, and available from Conoco Specialty Products, Inc. The grease was mixed well at about 300° F. and then milled using a three-roll mill to obtain a homogenous grease. The resulting grease had the following composition:

| Component | % (wt) |
|---|---|
| Example 62 Grease | 97.00 |
| CDR-102 | 3.00 |

The grease had the same adherent texture as the original Example 62 grease but also had an additional extreme stringy or gutty texture. This added textural feature was imparted by the extremely high molecular weight CDR-102. Even after the shearing conditions imparted during milling, the molecular weight of the CDR-102 was high enough to give the stringy texture. The ability of the grease to string-out when touched by and pulled apart from two surfaces is actually more a measure of cohesion and not adhesion. Such cohesive properties are not necessarily beneficial in applications such as railroad track/wheel flange greases unless good adhesive properties also exist. However, many potential customers of such greases believe that a stringy texture is an indication of good adhesive properties. Therefore, if such a property is included in the grease while also insuring good adhesive properties, the grease becomes more attractive. Applicant's use of an adhesive polymer such as styrene-isoprene copolymer complemented by a stringy polymer is an excellent way to provide a high performance product from an environmental and marketing viewpoint.

Among the many advantages of the novel adherent, low friction grease are:

1. Superior performance as a railroad track/wheel flange lubricant.
2. Outstanding friction reduction with associated train fuel economy.
3. Superior retentivity on the railroad track side.
4. Lower fling-off when applied as a railroad track/-wheel flange lubricant.
5. Excellent resistance to displacement by water (rain).
6. Non-corrosivity to copper, iron, and steel at prolonged high temperatures.
7. Impressive extreme pressure and wear resistance properties.
8. Non-abrasive to railroad track/wheel flange lubricators.
9. Oxidatively and thermally stable at high temperatures and at lower temperatures.
10. Prevention of lacquer-like deposits.
11. Good pumpability and mobility.
12. Remarkable compatibility and protection of elastomers and seals.
13. Excellent oil separation qualities, even at high temperatures.
14. Nontoxic.
15. Safe.
16. Environmentally acceptable.
17. Economical.
18. Effective.

Although embodiments of this invention have been described, it is to be understood that various modifications and substitutions, as well as rearrangements of process steps, can be made by those skilled in the art without departing from the novel spirit and scope of this invention.

What is claimed is:

1. An environmentally compatible railroad grease for lubricating railroad tracks and wheels of railway cars, comprising:

a base oil;

an additive package in the absence of molybdenum disulfide-containing compounds, sulfur-containing compounds, a substantial amount of graphite, and oxides of silicon, aluminum and iron, said additive package comprising extreme pressure wear-resistant additives for imparting extreme pressure properties to said railroad grease, said additives comprising a carbonate selected from the group consisting of a carbonate of a Group 1a alkali metal and a carbonate of a Group 2a alkaline earth metal;

said alkaline earth metal being selected from the group consisting of beryllium, magnesium, calcium, strontium, and barium;

said alkali metal being selected from the group consisting of lithium, sodium, potassium, rubidium, cesium, and francium; and a water-resistant hydrophobic polymeric additive.

2. A railroad grease in accordance with claim 1 wherein said additives further include a phosphate selected from the group consisting of a phosphate of a Group 1a alkali metal and a phosphate of a Group 2a alkaline earth metal.

3. A railroad grease in accordance with claim 1 wherein said carbonate comprises calcium carbonate.

4. A railroad grease in accordance with claim 3 wherein said additives further comprise tricalcium phosphate.

5. A railroad grease in accordance with claim 1, including a thickener comprising a member selected from the group consisting of polyurea, biurea, triurea, simple aluminum soap, aluminum complex soap, simple calcium soap, and calcium complex soap.

6. A railroad grease in accordance with claim 1, including a dropping point elevating additive comprising a member selected from the group consisting of polyurea, biurea, triurea, calcium complex soap, bentonite, clay, fumed silica, and silica compounds, said dropping point elevating additive being present in an insufficient amount to substantially thicken said grease.

7. A railroad grease in accordance with claim 1, including a boron-containing compound to substantially inhibit oil separation of said grease.

8. A railroad grease in accordance with claim 1 wherein said additive package is present in the absence of a fatty acid soap thickener, polyurea, biurea, and triurea.

9. A railroad grease in accordance with claim 1 wherein said polymeric additive comprises an adhesive polymer selected from the group consisting of: polyesters, polyamides, polyurethanes, polyoxides, polyamines, polyacrylamides, polyvinyl alcohol, ethylene vinyl acetate, polyvinyl acetate, polyvinyl pyrrolidone, polyolefins, polyolefin arylenes, polyarylenes, polymethacrylates, and boronated compounds thereof.

10. An environmentally compatible railroad grease for lubricating railroad tracks and wheels of railway cars, comprising by weight:

from about 45% to about 85% base oil;

from about 4% to about 30% of extreme pressure wear-resistant additives comprising calcium carbonate and a member selected from the group consisting of tricalcium phosphate and calcium sulfate; and from about 1% to about 10% of an adhesive-imparting high performance polymeric additive, said adhesive-imparting high performance polymeric additive interacting with said wear-resistant additive to substantially enhance the railroad retentivity of said grease in an environmentally safe manner.

11. A railroad grease for lubricating railroad tracks and wheels of railway cars in accordance with claim 10 wherein said grease comprises by weight:

at least 65% base oil;

from about 8% to about 20% extreme pressure wear-resistant additives; and from about 2% to about 6% adhesive-imparting high performance polymeric additive.

12. A railroad grease for lubricating railroad tracks and wheels of railway cars in accordance with claim 10 including from about 3% to about 14% by weight thickener comprising a member selected from the group consisting of polyurea, biurea, triurea, simple aluminum soap, aluminum complex soap, simple calcium soap, and calcium complex soap.

13. A railroad grease for lubricating railroad tracks and wheels of railway cars in accordance with claim 12 including from about 4% to about 8% by weight thickener.

14. A railroad grease for lubricating railroad tracks and wheels of railway cars in accordance with claim 10 including from about 0.1% to about 3% by weight of a dropping point elevating additive comprising a member selected from the group consisting of polyurea, biurea, triurea, calcium complex soap, bentonite, clay, fumed silica, and silica compounds, said dropping point elevating additive being present in an insufficient amount to substantially thicken said grease.

15. A railroad grease for lubricating railroad tracks and wheels of railway cars in accordance with claim 10 wherein said grease is selected from the group consisting of a colorless grease, neutral colored grease, and a translucent grease and said extreme pressure wear-resistant additives are food grade additives.

16. A railroad grease for lubricating railroad tracks and wheels of railway cars in accordance with claim 10 wherein said adhesive-imparting high performance polymeric additive comprises a polymeric additive with a monomeric unit comprising a member selected from the group consisting of an alkenyl substituted aryl group, an aryl substituted alkenyl group, and a non-aryl substituted alkenyl group.

17. A railroad grease for lubricating railroad tracks and wheels of railway cars in accordance with claim 10 wherein said adhesive-imparting high performance polymeric additive comprises styrene-isoprene copolymer.

18. A railroad grease in accordance with claim 10 wherein said base oil comprises an oil selected from the group consisting of naphthenic oil, paraffinic oil, aromatic oil, and a synthetic oil, said synthetic oil comprising at least one member selected from the group consisting of polyalphaolefin, polyolester, diester, polyalkyl ethers, polyaryl ethers, and silicone polymer fluids.

19. A railroad grease in accordance with claim 10 wherein said base oil comprises a mixture of two different refined, solvent-extracted, dewaxed base oils.

20. A railroad grease in accordance with claim 19 wherein said base oil comprises a ratio of about 2:1 of an 850 SUS refined solvent-extracted hydrogenated dewaxed base oil to a 150 SUS refined solvent-extracted base oil.

21. A railroad grease in accordance with claim 10 wherein said additives further comprise an oil soluble wear-resistant additive selected from the group consisting of 4,4'-methylene bis (dibutyl dithiocarbamate), triaryl phosphate, and zinc dialkyldithiophosphate.

22. A railroad grease in accordance with claim 10 wherein said member comprises tricalcium phosphate.

23. A railroad grease in accordance with claim 10 wherein said member comprises calcium sulfate.

24. A railroad grease in accordance with claim 23 wherein said extreme pressure wear-resistant additive further comprises hydroxide.

25. A railroad grease in accordance with claim 24 wherein said hydroxide comprises calcium hydroxide.

* * * * *

UNITED STATES PATENT AND TRADEMARK OFFICE

CERTIFICATE OF CORRECTION

PATENT NO. : 5,158,694

DATED : October 27, 1992

INVENTOR(S) : John Andrew Waynick

It is certified that error appears in the above-identified patent and that said Letters Patent is hereby corrected as shown below:

| Column | Line | |
|---|---|---|
| 6 | 15 | "fracium" should be - -francium.- - |
| 8 | 27 | "For best result," should be - -For best results,- - |
| 12 | 8 | "unsaturate" should be - -unsaturated - - |
| 12 | 24 | "th diisocy-" should be --the diisocyanate --. |
| 17 | 67-68 | "acids group" should be - -acids groups- - |
| 43 | 54-55 | "The greases were tested and had the following performance properties" (sentence should be deleted.) |

Signed and Sealed this

Sixteenth Day of November, 1993

*Attest:*

*Attesting Officer*

BRUCE LEHMAN

*Commissioner of Patents and Trademarks*